US009982452B2

(12) United States Patent
Hui et al.

(10) Patent No.: US 9,982,452 B2
(45) Date of Patent: May 29, 2018

(54) POOL CLEANER

(71) Applicants: Wing-Tak Hui, Hong Kong (CN); Andrew Matthew Hui, San Jose, CA (US); Wing-Kin Hui, Hong Kong (CN)

(72) Inventors: Wing-Tak Hui, Hong Kong (CN); Andrew Matthew Hui, San Jose, CA (US); Wing-Kin Hui, Hong Kong (CN)

(73) Assignee: COMPUROBOT TECHNOLOGY COMPANY, Dongguan, Guangdong (CN)

( * ) Notice: Subject to any disclaimer, the term of this patent is extended or adjusted under 35 U.S.C. 154(b) by 34 days.

(21) Appl. No.: 14/623,442

(22) Filed: Feb. 16, 2015

(65) Prior Publication Data

US 2015/0337555 A1 Nov. 26, 2015

Related U.S. Application Data

(63) Continuation-in-part of application No. 14/284,386, filed on May 21, 2014, now Pat. No. 9,091,092.

(51) Int. Cl.
*E04H 4/16* (2006.01)

(52) U.S. Cl.
CPC ..... *E04H 4/1636* (2013.01); *E04H 4/1618* (2013.01)

(58) Field of Classification Search
CPC ..... E04H 4/16; E04H 4/1618; E04H 4/1654; E04H 4/1663
USPC ..... 15/1.7
See application file for complete search history.

(56) References Cited

U.S. PATENT DOCUMENTS

| | | | | |
|---|---|---|---|---|
| 4,168,557 | A * | 9/1979 | Rasch | E04H 4/1654 15/1.7 |
| 4,338,697 | A * | 7/1982 | Broadwater | E04H 4/1609 15/1.7 |
| 4,962,559 | A * | 10/1990 | Schuman | E04H 4/1618 15/1.7 |
| 5,842,243 | A * | 12/1998 | Horvath | E04H 4/1636 15/1.7 |
| 6,013,178 | A | 1/2000 | Strano et al. | |
| 6,358,425 | B1 | 3/2002 | King | |
| 6,502,269 | B1 * | 1/2003 | Balchan | E04H 4/1636 15/1.7 |
| 6,797,157 | B2 | 9/2004 | Erlich | |
| 6,842,931 | B2 * | 1/2005 | Porat | E04H 4/1654 15/1.7 |
| 6,939,460 | B2 | 9/2005 | Erlich | |
| 7,060,182 | B2 | 6/2006 | Erlich et al. | |
| 7,437,790 | B1 | 10/2008 | Ajello | |

(Continued)

FOREIGN PATENT DOCUMENTS

| | | |
|---|---|---|
| CA | 2466242 A1 | 11/2005 |
| CN | 201883718 U | 6/2011 |

(Continued)

*Primary Examiner* — Laura C Guidotti
(74) *Attorney, Agent, or Firm* — Jennifer A. Haynes; Bowen Liu; David Lewis

(57) ABSTRACT

A pool cleaner having a coarse filter and a fine filter. The coarse filter removes large pieces of debris. The fine filter removes fine particles from the water. In an embodiment, the fine filter is a filter bag made from a cloth material. In an embodiment, the coarse filter is a mesh grating with small holes. In an embodiment, the fine filter is supported by a rigid mesh placed downstream from the coarse filter.

32 Claims, 27 Drawing Sheets

(56) References Cited

U.S. PATENT DOCUMENTS

| | | | | |
|---|---|---|---|---|
| 8,281,441 | B1 | 10/2012 | Erlich et al. | |
| 9,091,092 | B1 | 7/2015 | Hui et al. | |
| 9,246,290 | B1 | 1/2016 | Hui et al. | |
| 9,366,049 | B1 | 6/2016 | Hui et al. | |
| 2002/0104790 | A1 | 8/2002 | Lincke | |
| 2003/0182742 | A1 | 10/2003 | Wichmann et al. | |
| 2005/0247613 | A1 | 11/2005 | Bishop et al. | |
| 2007/0067930 | A1 | 3/2007 | Garti | |
| 2008/0035543 | A1 | 2/2008 | Bloch et al. | |
| 2009/0229061 | A1 | 9/2009 | Stoltz et al. | |
| 2012/0103365 | A1* | 5/2012 | Sumonthee | E04H 4/1654 134/18 |
| 2015/0233135 | A1 | 8/2015 | Hui et al. | |
| 2016/0013603 | A1 | 1/2016 | Hui et al. | |
| 2016/0145885 | A1 | 5/2016 | Hui et al. | |
| 2016/0168872 | A1 | 6/2016 | Hui et al. | |

FOREIGN PATENT DOCUMENTS

| | | | |
|---|---|---|---|
| CN | 104895355 | A | 9/2015 |
| EP | 2949837 | A1 | 12/2015 |
| WO | WO 2006/128111 | A2 | 11/2006 |

* cited by examiner

130

POOL CLEANER

CROSS-REFERENCE TO RELATED APPLICATIONS

This application is a continuation-in-part of U.S. patent application Ser. No. 14/284,386, now U.S. Pat. No. 9,091,092, entitled, "POOL CLEANER," filed May 21, 2014, by Joseph Hui et al., which is incorporated herein by reference.

FIELD OF THE INVENTION

The current specification relates generally to pool cleaners.

BACKGROUND

The subject matter discussed in the background section should not be assumed to be prior art merely as a result of its mention in the background section. Similarly, a problem and the understanding of the causes of a problem mentioned in the background section or associated with the subject matter of the background section should not be assumed to have been previously recognized in the prior art. The subject matter in the background section merely represents different approaches, which in and of themselves may also be inventions.

Presently, there are various pool cleaners that can clean swimming pools by filtering the pool water and removing dirt debris and algae. However, prior pool cleaners are inefficient in filtering pool water and removing dirt debris. Pool cleaners with a fine filter may clog up easily from the buildup of large debris within the pool cleaner, which ends up blocking water flow through the cleaner. Consequently, users are required to clean the captured debris off the filter multiple times so as not to reintroduce the captured debris back into the pool after use.

On the other hand, pool cleaners with a course filter may only capture large debris and allow smaller particles to pass through. Subsequently, the pool water may need to be pumped through the pool cleaner multiple times or use different pool cleaners to effectively remove all the debris from the water.

BRIEF DESCRIPTION OF THE DRAWINGS

In the following drawings, like reference numbers are used to refer to like elements. Although the following figures depict various examples, the one or more implementations are not limited to the examples depicted in the figures.

DETAILED DESCRIPTION

Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

In general, at the beginning of the discussion of each of FIGS. 1-27 is a brief description of each element, which may have no more than the name of each of the elements in the particular figure that is being discussed. After the brief description of each element, each element of FIGS. 1-27 is further discussed in numerical order. In general, each of FIGS. 1-27 is discussed in numerical order, and the elements within FIGS. 1-27 are also usually discussed in numerical order to facilitate easily locating the discussion of a particular element. Nonetheless, there is not necessarily any one location where all of the information of any element of FIGS. 1-27 is located. Unique information about any particular element or any other aspect of any of FIGS. 1-27 may be found in, or implied by, any part of the specification.

Figure 1:
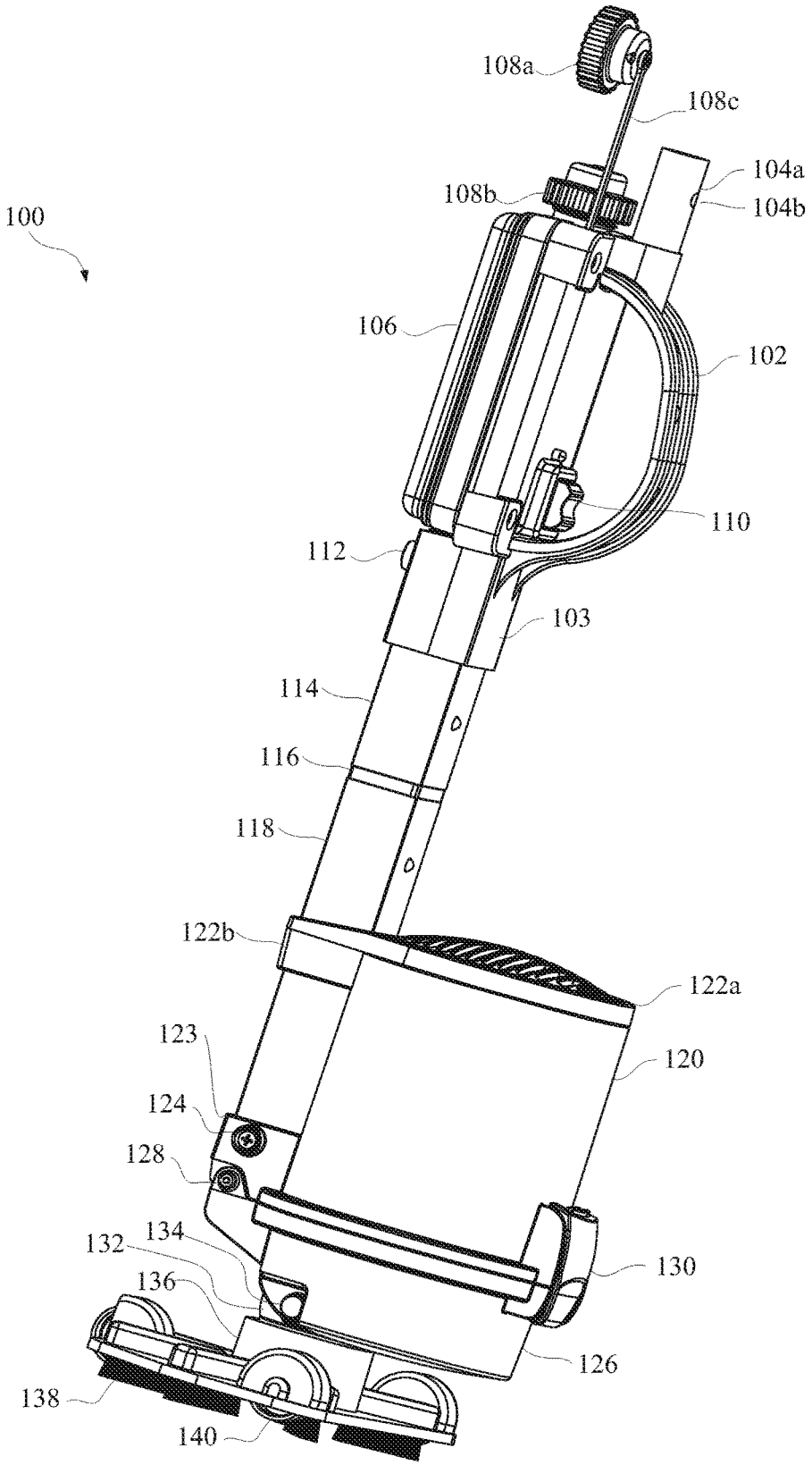
FIG. 1 shows a diagram of an embodiment of a pool cleaner.

FIG. 1 shows a diagram of an embodiment of pool cleaner 100. Pool cleaner 100 includes handle 102, handle socket 103, pole connector 104*a*, hole 104*b*, power pack 106, electrical cap 108*a* and 108*b*, cap connector 180*c*, on/off switch 110, bracket screws 112, handle connector 114, link 116, body connector 118, body chamber 120, discharge cover 122*a*, brace 122*b*, socket 123, fastener 124, dirt tray 126, dirt tray pivot 128, latch 130, pivot mount 132, pivot cover 134, vacuum head 136, bristles 138, and wheels 140. In other embodiments, pool cleaner 100 may not have all of the components listed above or may have other components instead of and/or in addition to those listed above.

Pool cleaner 100 is a portable cleaner that may be used to remove debris and filter pool water. Generally, pool cleaner 100 may be submerged and operated under water. Optionally pool cleaner 100 may be submerged before turning on pool cleaner 100. When pool cleaner 100 is turned on, the pump within pool cleaner 100 starts. Consequently, the water inside the body is pushed out through the discharge opening of the body, creating a vacuum within the body. The vacuum causes water from the pool to flow into the body through the intake opening. The water is then pushed out of the body by the pump. A pair of filters, including a coarse filter and a fine filter, within the body blocks any debris in the water from passing through as the water flows in and out of the body, thereby filtering the water. The process is performed until the pool water is clean or until the filter needs to be cleaned. In an embodiment, pool cleaner 100 is portable and is light enough and small enough that pool cleaner 100 may be carried from place to place by a single individual by the handle. Pool cleaner 100 may be operated by a single individual holding the handle and/or by connecting a pole to the handle, so that pool cleaner 100 may be operated in deep water without the user being in the pool, for example.

Handle 102 is connected to a body chamber by a handle connector shaft. In an embodiment, handle 102 is optional. Handle 102 may help in carrying pool cleaner 100 and may provide better control in operating pool cleaner 100. At the opposite end of handle 102, a pole connector may be attached to handle 102 for the purpose of extending the reach of pool cleaner 100.

Handle socket 103 is a hole into which a pole (or other connector) may be inserted to attach the handle to the rest of the pool cleaner, via the pole. In this specification, the words pole and shaft are used interchangeably and either term may be substituted for the other to obtain different embodiments. In an embodiment, handle socket 103 is a pole shaped element having an opening for inserting or connecting a handle connector (which may be a pole) to handle 102. In another embodiment, instead of the connector being inserted into handle socket 103, the connector may slide over handle socket 103. In one embodiment, the hole forming handle socket 103 may be having a cross section that is rectangular (e.g., square). In another embodiment, the hollow opening has a cross section that may be triangular, circular, hexagonal, ovular, or any other shape. In one embodiment, the connector could be fastened to handle socket 103 using bracket screws.

Pole connector 104*a* is a socket for inserting a pole to extend the reach of pool cleaner 100. A pole, such as a long metal pole, may connect to pool cleaner 100 at pole connector 104*a*, thereby making the pool cleaner 100 longer. By using a pole, the user does not have to be as close to the pool cleaner 100, so that the user does not need to be in the water or touch the water while operating the pool cleaner 100. In an embodiment, pole connector 104*a* is a hollow tube that is slightly smaller in diameter than the pole and extends out of handle 102. In such an embodiment, the pole fits over pole connector 104*a*, and engages with the pole connector 104*a*. In another embodiment, pole connector 104*a* is slightly wider in diameter than the pole, and the pole slides into and engages the pole connector 104*a*. Pole connector 104*a* may create a connection between the pole and handle 102 from within the pole. In an embodiment, pole connector 104*a* has a locking mechanism, such as spring loaded buttons, to keep the pole from slipping off and/or rotating with respect to pool cleaner 100.

Hole 104*b* is a circular opening in the side of pole connector 104*a*. Although not visible in FIG. 1, in an embodiment, there may be a second hole in pole connector 104*a* opposite hole 104*b* and aligned with hole 104*b*. In an embodiment, spring loaded buttons are inserted into hole 104*b* to hold the pole to pole connector 104*a*. Hole 104*b* is one embodiment of an element that may be used for fastening a pole to pole connector 104*a*. In other embodiments, another type of fastener may be used.

Power pack 106 is the housing for the power source of pool cleaner 100. The electricity from power pack 106 powers the pump within the pool cleaner 100. Power pack 106 may contain a set of rechargeable batteries that may be connected to an alternating current ("AC") outlet or an external battery pack. Consequently, power pack 106 may have an electrical port at one end for connecting to an electrical cord plugged into an AC outlet. The electrical port may be closed by an electrical cap to prevent water from entering into the electrical port and damaging the power pack 106. In an embodiment, power pack 106 is a replaceable unit for situations where power pack 106 is damaged or has run out of charge. Power pack 106 attaches to handle 102. In an embodiment power pack 106 is screwed to handle 102. In other embodiments, other fasteners may be used instead of screws. In an embodiment where pool cleaner 100 does not have handle 102, power pack 106 is a detached unit that connects to body chamber by a cord. In at least one embodiment, power pack 106 is less dense than water, allowing power pack 106 to float on the pool surface.

Electrical cap 108*a* and electrical cap 108*b* are the same cap in different states or configurations. Specifically, electrical cap 108*a* depicts the situation when the electrical cap is to be detached, hanging by a string, allowing a plug to be connected to charge battery blocks that is enclosed in the power pack 106 to recharge power pack 106. Electrical cap 108*b* depicts the situation when the electrical cap 108*b* is screwed on (or otherwise securely fastened) to prevent water from coming in contact with the electrical connectors inside power pack 106 when pool cleaner 100 is in use. Electrical cap 108*a*/108*b* has a water seal to prevent water from entering into the electrical port and damaging power pack 106, while pool cleaner 100 is in use.

Cap connector 108*c* keeps electrical cap 108*a* connected to pool cleaner 100, so that electrical cap 108*a* is unlikely to be misplaced, while power pack 106 is recharging (as shown in FIG. 1, for example). When pool cleaner 100 is in use electrical cap 108*b* is screwed preventing water from coming in contact with the electrical connectors used for charging power pack 106. In an embodiment, the cap connector 108*c* is a cord, such as a string. Cap connector 108*c* is optional.

On/off switch 110 is a switch that controls the pump within body chamber. More specifically, on/off switch 110 controls the flow of electricity from the power pack 106 to the pump. In an embodiment, on/off switch 110 is connected to power pack 106. On/off switch 110 may have a rubber jacket covering the switch to prevent water from entering into on/off switch 110 and affecting the electrical components within. In another embodiment, on/off switch 110 may be located on handle 102 for easy access when holding pool cleaner 100 by the handle 102. In another embodiment, on/off switch 110 may located on one of the connectors or on the body of pool cleaner. In the embodiment of FIG. 1, on/off switch 110 slides between an on position and an off position. In another embodiment, on/off switch 110 may be a button. Handle 102 may include handle socket 103, pole connector 104*a*, hole 104*b*, power pack 106, electrical cap 108*a* and 108*b*, cap connector 108*c*, on/off switch 110, and bracket screws 112.

Bracket screws 112 are two screws that affix handle 102 to one end of a connector for connecting the handle 102 to pool cleaner 100 (only one of bracket screws 112 is shown in FIG. 1). Handle 102 is held in place on pool cleaner 100 by handle socket 103 using bracket screws 112. Additionally, bracket screws 112 may provide structural reinforcement and stability for handle 102, allowing the pool cleaner 100 to be carried and controlled using handle 102.

Handle connector 114 connects to handle 102 on one end and to a second connector on the other end to, ultimately, connect the handle connector 114 to the body of the pool cleaner 100. In an embodiment, handle connector 114 is a shaft having a cross section that fits into (or over) handle socket 103. Handle socket 103 is connected, via bracket screws 112, to handle connector 114, thereby connecting handles 102 to handle connector 114. In an embodiment, handle connector 114 has a screw hole for receiving bracket screw 112

Link 116 is a shaft or pole that connects the connector 114 (which is coupled with to power pack 106) to the connector on the body of the pool cleaner 100.

Body connector 118 is a shaft connected to the body of the pool cleaner 100 that connects, via link 116, to handle connector 114 on one end and to body chamber 120 on the other end. When combined, handle connector 114, link 116, and body connector 118 form a long connector, connecting handle 102 (which carries power pack 106) to body chamber 120, providing an extended reach to pool cleaner 100. Handle connector 114, link 116, and body connector 118 may be a hollow rod or bar. Additionally, handle connector 114, link 116, and body connector 118 may be made of a metallic or plastic material. In an embodiment, handle connector 114, link 116, and body connector 118 may have cross sections that are not rectangular, but could be circular, hexagonal, ovular, and/or any other shape. In an embodiment, the combination of connectors may have more connectors and links than those listed above, allowing pool cleaner 100 to be longer. Consequently, a user may be able to reach further with pool cleaner 100. In another embodiment, the combination connectors may have fewer connectors than those listed above, which may (or may not) shorten the distance between handle 102 and the body chamber, thereby allowing the user to have more control of pool cleaner 100. In other embodiments, body connector 118 has one corner side shaved off on the end connecting to body chamber to allow space within the connecting slot of body chamber for a pivot for a dirt tray to run through.

Body chamber 120 is the housing for the pump and the filters and is the body of pool cleaner 100. Body chamber 120 may be hollow and cylindrically shaped with two open ends. One end of body chamber 120 may be the intake end, and the other open end may be the discharge end. The opening of the intake end may be larger than the opening of the discharge end. The intake end may be covered by a mesh filter while the discharge end is covered by discharge cover. In an embodiment, body chamber 120 has one or more extended portions (e.g., a socket and/or ring within which body connector 118 fit) that allows one end of body connector 118 to connect with body chamber 120. In such embodiment, the body connector 118 is affixed to a socket on body chamber 120 by a screw. In another embodiment, the density of body chamber 120 with all of the contents (including air) and the components within body chamber 120 is equal to or greater than water, allowing body chamber 120 to sink in water, keeping the pump immersed in water, which protects the seal from dry running in the air. The seal could be damaged if the seal is allowed to dry in the air. Body chamber may include discharge cover 122*a* and a fastener.

Discharge cover 122*a* covers the discharge end of body chamber 120, and discharge cover 122*a* is a protective covering that prevents large pieces of dirt from entering body chamber 120 and protects the pump from colliding with any large objects that may fall on pool cleaner 100 while the cleaner is not in use. Discharge cover 122*a* has multiple openings, such as slits, that allow water to flow out of body chamber 120 and back into the pool. In an embodiment, discharge cover 122*a* has an extended portion that connects to body connector 118 to hold discharge cover 122*a* in place. The extended portion may allow discharge cover 122*a* to slide up and down the body connector 118.

Brace 122*b* is a loop through which body connector 118 is passed through, which help hold body connector 118 in place. In an embodiment, brace 122*b* may be part of discharge cover 122*a*.

Socket 123 receives body connector 118, and socket 123 is attached to the body chamber of pool cleaner 100. Socket 123 holds body connector 118 in place on the pool cleaner 100.

Fastener 124 is a screw (or other fastener) that affixes socket 123 of body chamber 120 to body connector 118 to prevent body connector 118 from slipping out of socket 123.

Dirt tray 126 is a tray that catches the dirt and debris removed from the pool water during the operation of pool cleaner 100. Like body chamber 120, dirt tray 126 may be hollow and cylindrically shaped with two open ends, where one end may be the intake end and the other end may be the discharge end. The opening of the intake end may be smaller than the opening of the discharge end. Because of the water flowing through dirt tray 126, the discharge end of dirt tray 126 is connected to the intake end of body chamber 120. In an embodiment, dirt tray 126 and body chamber 120 are pivotally attached on one side by a pivot (to form a hinge), so that dirt tray 126 can be opened and cleaned out after each use. In an embodiment, the dirt tray 126 is closed and held locked during use by a locking latch, to contain the water within dirt tray 126 and body chamber 120 and prevent debris from falling out. In another embodiment, dirt tray 126 has a second opening on the intake side in addition to the intake opening where a pivot mount is connected. In at least one embodiment, pool cleaner 100 includes a housing that is made up of the body chamber 120 and the dirt tray 126. For example, the housing may be formed from the combination of the body chamber 120 and dirt tray 126.

Dirt tray pivot 128 is a pivot rod that holds dirt tray 126 and body chamber 120 together. Dirt tray pivot 128 allows dirt tray 126 to swing freely while one end is attached to body chamber 120. In an embodiment, dirt tray pivot 128 is a rod.

Latch 130 is a mechanical fastener, such as a latch, that holds body chamber 120 and dirt tray 126 together, closing and locking the two components. Latch 130 may have a clasp or hook portion that is located on the intake side of body chamber 120, opposite to dirt tray pivot 128. The clasp or hook portion may have a spring mechanism. To close and lock dirt tray 126, the clasp or hook portion of latch 130 fits over the receiving portion located on dirt tray 126 and hooks onto the receiving portion. The receiving portion may be a hook for the clasp or hook portion of latch 130 to link onto.

Pivot mount 132 is a structure on which the body of the pool cleaner 100 is mounted. Pivot mount 132 connects the vacuum head to the rest of the pool cleaner 100 in a manner that allows the vacuum head to rotate. In an embodiment, pivot mount 132 also constitutes the intake nozzle of pool cleaner 100. In the embodiment shown in the FIGS., pivot mount 132 has a sphere-shaped top portion connected to a cylindrical bottom portion. Pivot mount 132 has an opening in the top portion connected by a channel to an opening in the bottom portion, creating a passage for water to flow through. In an embodiment, pivot mount 132 is hollow. The top portion of pivot mount 132 connects to the intake end of dirt tray 126 while the bottom portion of pivot mount 132 connects to the vacuum head. Pivot mount 132 may allow the vacuum head to pivot when pool cleaner 100 is in use. More specifically, with pivot mount 132 connected, the vacuum head may be horizontal to the pool surface while body chamber 120 is tilted up to 45 degrees from the pool surface. In an embodiment, pivot mount 132 rotateably connects to dirt tray 126 and is held in place by a pivot. Pivot mount 132 will be discussed further, below, in conjunction with FIG. 9. In other embodiments, pivot mount 132 allows the vacuum head to rotate more than 45 degrees with respect to the body of pool cleaner 100.

Pivot cover 134 is a cap that covers the pivot running through dirt tray 126 and pivot mount 132, which protects the pivot and may help keep pivot mount 132 from sliding sideways with respect to dirt tray 126.

Vacuum head 136 is a detachable nozzle that controls the intake of water into pool cleaner 100. Vacuum head 136 is attached to the pivot mount 132. Vacuum head 136 may include a base plate, which may include bristles and wheels. The base plate may be a flat surface that gives the pool cleaner 100 the stability to stand upright when placed on the ground. In another embodiment, vacuum head 136 is a straight nozzle without a base plate. In some embodiments, vacuum head 136 is made out of a rigid material.

Bristles 138 are stiff hair-like structures attached to the base plate of vacuum head 136. Bristles 138 may be made from synthetic or natural material. In an embodiment, bristles 138 form rows along the bottom of the base plate, allowing the user to effectively scrub the pool surfaces with pool cleaner 100, loosening dirt on the bottom of the pool, while filtering the pool water. In an embodiment, bristles 138 are located in a rectangular trough that snap into wells on the base plate of the vacuum head that have a similar shape as the troughs. Alternatively, the troughs may be glued, screwed, or attached by another means to the base plate or bristles 138 may be attached directly to the base plate of the vacuum head.

Wheels 140 are pivotally attached to base plate of vacuum head 136 to provide better mobility for pool cleaner 100 when the base plate is moving across the pool surfaces. In an embodiment, wheels 140 are placed to maintain stability of pool cleaner 100. In an embodiment, there are three wheels attached to the base place. In another embodiment there are 4 wheels attached to the base plate. In other embodiments, there may be other numbers of wheels attached to the base plate.

Exploded View

Figure 2:
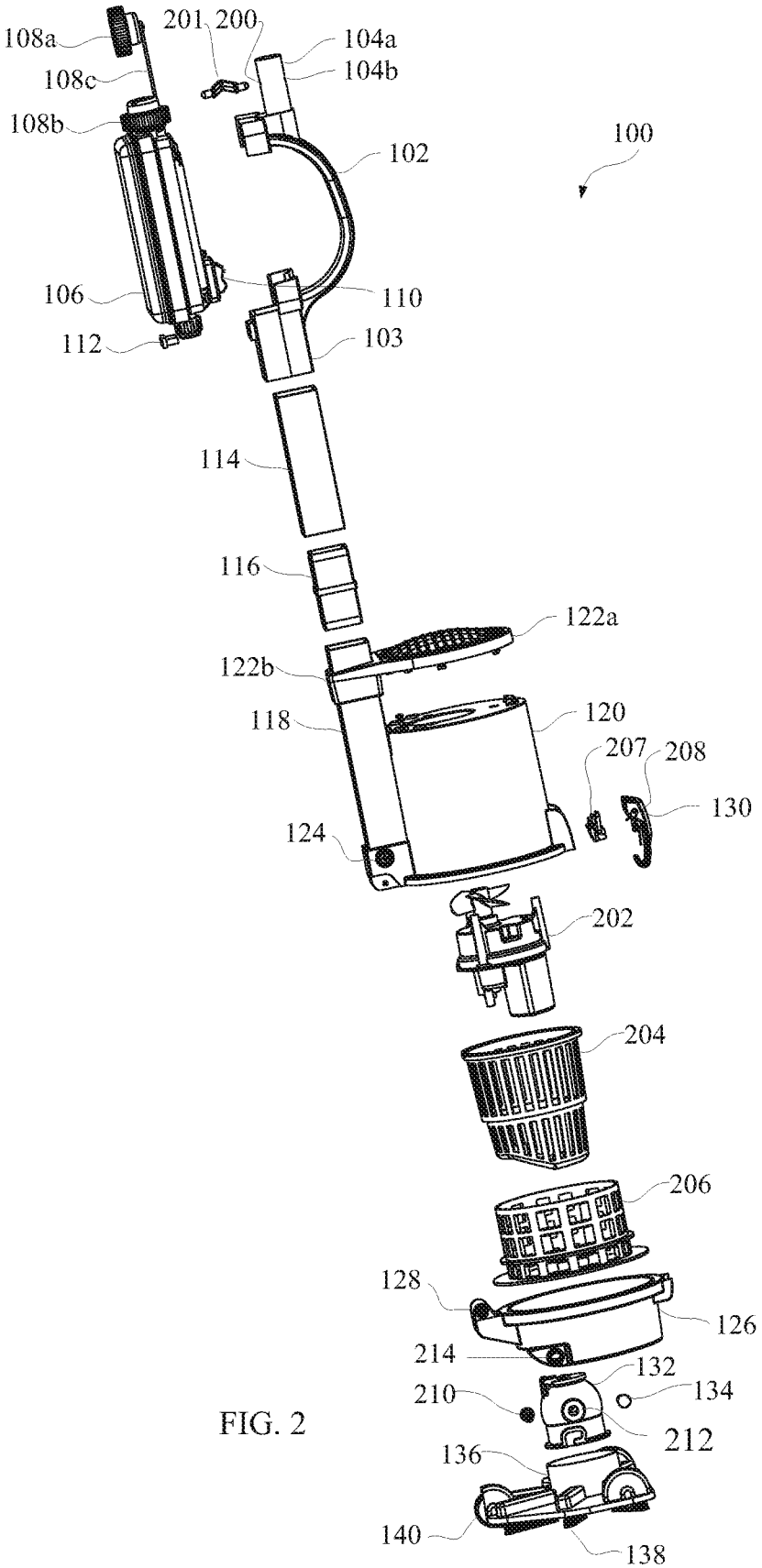
FIG. 2 shows an exploded view of an embodiment of the pool cleaner of FIG. 1.

FIG. 2 shows an exploded view of an embodiment of pool cleaner 100. FIG. 2 includes handle 102, handle socket 103, pole connector 104*a*, hole 104*b*, power pack 106, electrical caps 108*a* and 108*b*, cap connector 108*c*, on/off switch 110, bracket screws 112, handle connector 114, link 116, body connector 118, body chamber 120, discharge cover 122*a*, brace 122*b*, fastener 124, dirt tray 126, dirt tray pivot 128, latch 130, pivot mount 132, pivot cover 134, vacuum head 136, bristles 138, wheels 140, hole 200, locking pin 201, pump 202, pump cage 204, rigid mesh 206, latch mount 207, spring 208, pivot 210, pivot hole 212, and pivot 214. In other embodiments, pool cleaner 100 may not have all of the components listed above or may have other components instead of and/or in addition to those listed above.

Hole 200 is located opposite to and aligned with hole 104*b* on pole connector 104*a*. Locking pin 201 is a pin that ensures the pole connecting to pole connector 104*a* is securely fastened, preventing the pole from slipping off pole connector 104*a*. Locking pin 201 may be V-shaped with two buttons jutting out parallel to a line joining the two ends of the V to fit into the corresponding holes 104*b* and 200 in pole connector 104*a*. The V-shape allows the user to pinch the middle portion of locking pin 201 to remove locking pin 201 from the locked position in pole connector 104*a*. The V portion mechanically biases the buttons on the end of the V pushing the buttons outward. The locking pin 201 is inserted into pole connector 104*a*, with the button ends protruding out through holes 104*b* and 200, thereby creating spring biased push buttons. The pole that connects to pole connector 104*a* may have two holes that align with holes 104*b* and 200, and the buttons protrude through both the holes in the pole and pole connector 104*a*, thereby holding the pole to pole connector 104*a*. The pole can then be removed from pole connector 104*a* by pushing the buttons at the ends of the V inwards and simultaneously sliding the pole upwards. In other embodiment, the V portions may be replaced with a rod that slides in a tube, where one button in at one end of the rod and the other buttons is at one end of the tube, and a coil spring pushes the rod and tube, and therefore the buttons on the rod and tube away from one another. In other embodiments, other mechanisms of creating spring loaded buttons can be used.

Pump 202 is a water pump that is capable of moving water surrounding the pump 202. More specifically, pump 202 draws water into body chamber 120 and pushes water out of body chamber 120. Pump 202 may have an intake end and a discharge end. In an embodiment, pump 202 may have a propeller to move the water through the pool cleaner 100. In an embodiment having a propeller, the end of pump 202 that has the propeller is the discharge end (alternatively, the propeller may be placed on the intake end and spun in the opposite direction as were the propeller on the discharge end). Pump 202 may be an electromechanical pump that is powered by an electric motor using a magnetic field. Pump 202 is further described, below, in conjunction with FIG. 3 and FIGS. 20A-E.

Pump cage 204 encases pump 202 within a mesh, preventing the filter bag from touching pump 202 when the filter bag is under hydraulic pressure. Pump cage 204 may be a rigid mesh. In an embodiment, pump cage 204 covers the sides and intake end of pump 202. In such embodiment, the discharge-end points away from the pump cage 204 and outward through an opening in pump cage 204 that does not have a mesh.

Rigid mesh 206 is a support for the filter that fits within body chamber 120 for maintaining the structure of filter bag while opening and closing the pool cleaner 100 and in other situations, such as when pump 202 is off. In one embodiment, rigid mesh 206 may not be perfectly rigid. Rigid mesh 206 may be cylindrically shaped and hollow. In an embodiment, rigid mesh 206 is open at the top and bottom of the cylinder portion, so as to allow fluid to flow through the rigid mesh 206. The top opening is covered with the filter. Optionally, rigid mesh 206 may have numerous openings along the sides to allow water to pass through. In an embodiment, rigid mesh 206 is placed at the intake end of the body chamber 120 but still within body chamber 120. In another embodiment, the diameter of rigid mesh 206 is slightly less than the diameter of body chamber 120, leaving some space between the interior walls of the body chamber 120 and the rigid mesh 206. When pump 202 is off, the bag filter may rest on rigid mesh 206. In other embodiments, the length of rigid mesh 206 may be less than the length of body chamber 120. For example, rigid mesh 206 may be a quarter, a third, a half, two thirds, or three quarters of the length of body chamber 120. In other embodiments, rigid mesh 206 may have other shapes (e.g., rectangular, ovular, triangular, or hexagonal).

Latch mount 207 attaches to body chamber 120, and latch 130 is mounted on latch mount 207.

Spring 208 is attached to latch 130, mechanically biasing the clasp or hook portion of latch 130 to stay closed after the clasp or hook portion engages the receiving portion on dirt tray 126.

Pivot 210 is a cylindrical shaped element that runs through a hole in dirt tray 126 and a hole in pivot mount 132, ensuring that pivot mount 132 is pivotally connected to dirt tray 126. Pivot 210 may be a peg that engages pivot cover 134 to hold pivot 210 in place. Pivot 210 may be covered by pivot cover 134. When assembled, body chamber 120 may pivot on pivot 210 about an axis passing through pivot 210. In other embodiments, nut and bolt or a screw and screw socket may replace pivot 210 and pivot cover 134.

Pivot hole 212 aligns with pivot holes in the bottom of dirt tray 126, which are pivotally connected together by pivot 210 to form a hinge on which dirt tray 126 pivots while supported by pivot mount 132.

Pivot holes 214 aligns with pivot holes 212 on pivot mount 132, which are pivotally connected together by pivot 210 to form a hinge on which dirt tray 126 pivots while supported by pivot mount 132.

Cross-Sectional Views

Figure 3:
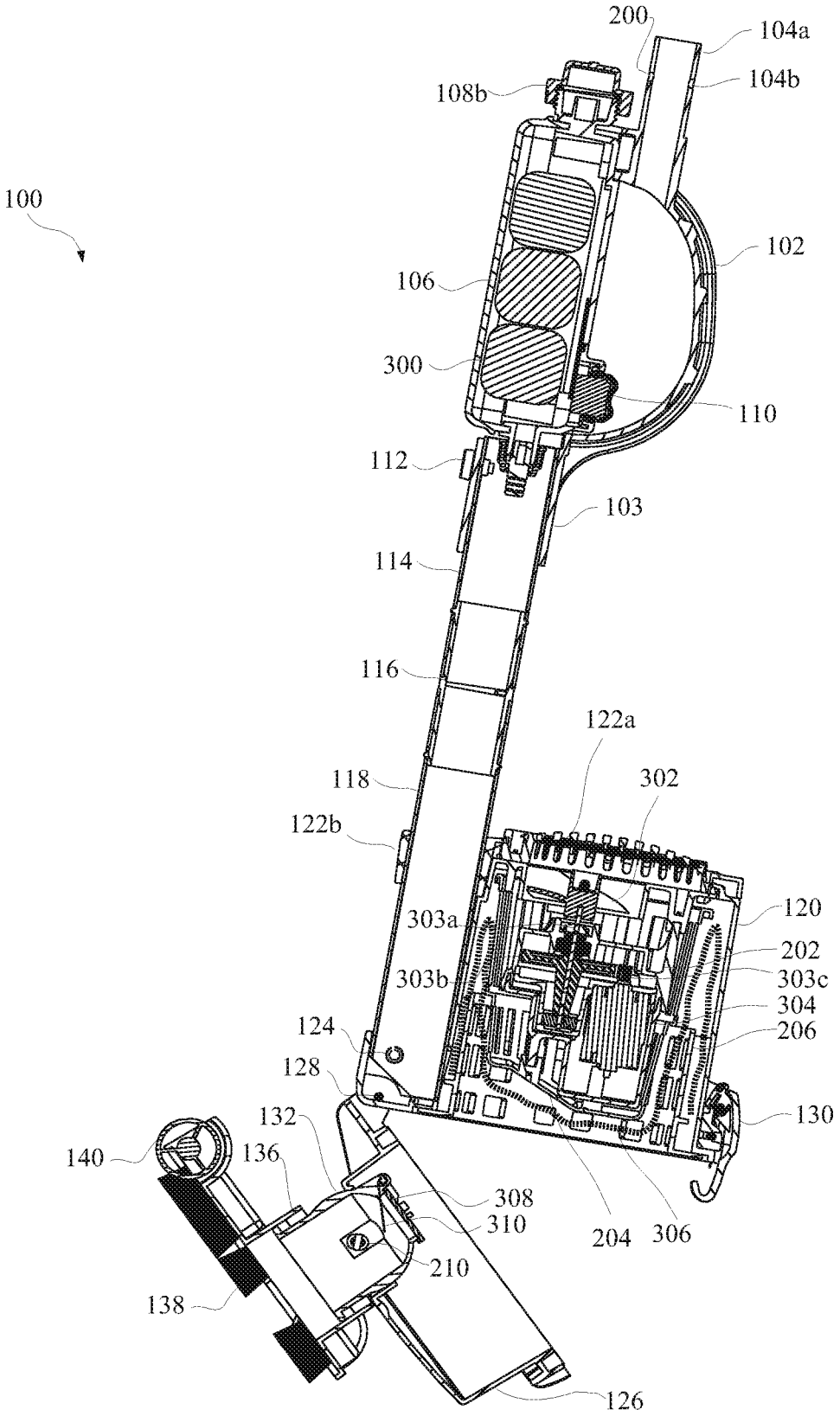
FIG. 3 shows a cross-sectional view of an embodiment of the pool cleaner of FIG. 1.

FIG. 3 shows a cross-sectional view of an assembly having an embodiment of pool cleaner 100. FIG. 3 includes handle 102, handle socket 103, pole connector 104*a*, hole 104*b*, power pack 106, electrical cap 108*b*, on/off switch 110, bracket screws 112, handle connector 114, link 116, body connector 118, body chamber 120, discharge cover 122*a*, brace 122*b*, fastener 124, dirt tray 126, dirt tray pivot 128, latch 130, pivot mount 132, vacuum head 136, bristles 138, wheels 140, pump 202, pump cage 204, rigid mesh 206, pivot 210, battery blocks 300, propeller 302, axle 303*a*, axle gear 303*b*, motor gear 303*c*, motor 304, filter bag 306, spring loaded door 308, and spring 310. In other embodiments, pool cleaner 100 may not have all of the components listed above or may have other components instead of and/or in addition to those listed above.

Battery blocks 300 are the power source of pool cleaner 100 and are housed within power pack 106. Battery blocks 300 may be rechargeable batteries that may be plugged into an AC outlet or an external battery to recharge.

Propeller 302 is a fan blade on pump 202 that rotates, causing the surrounding water to move. Propeller 302 may be powered by a motor.

Axle 303*a* is the axle on which propeller 302 is mounted. Turning axle 303*a* turns propeller 302. Axle 303*a* may be mounted in holes or wells in the housing of pump 202. Axle gear 303*b* turns axle 303*a*. Motor gear 303*c* is a gear mounted on the shaft of the motor and engages axle gear 303*b*. As the motor rotates the axle shaft, motor gear 303*c* rotates, which in turn rotates axle gear 303*b*, which in turn rotates axle 303*a*, thereby rotating propeller 302. The ratio of the diameter of axle gear 303*b* and motor gear 303*c* determines the ratio of the speed of rotation of the motor shaft and the propeller 302.

Motor 304 is an electric motor located within pump 202 that turns propeller 302 when electricity is provided, by rotating motor gear 303*c* (which in turn rotates axle gear 303*b*, causing axle 303*a* to rotate, which rotates propeller 302). In an embodiment, motor 304 is an electric motor that uses a magnetic field. When the user turns on pool cleaner 100 by flipping the on/off switch 110, the electricity from battery blocks 300 within power pack 106 may travel through an electrical cord to motor 304, powering pump 202, and turning propeller 302.

Filter bag 306 is a filter shaped as a bag that fits in between rigid mesh 206 and pump cage 204. Filter bag 306 may be a fabric that allows water to pass and blocks large particles. In an embodiment, filter bag 306 may fit inside rigid mesh 206, lining the interior of rigid mesh 206, with the ends of filter bag 306 wrapping around the outside of rigid mesh 206. In such embodiment, filter bag 306 covers the interior and exterior of rigid mesh 206. Filter bag 306 may be given some form and some structure by rigid mesh 206. In another embodiment, filter bag 306 may touch the sides of pump cage 204 when under hydraulic pressure (e.g., as a result of pump 202 being turned on). In such embodiment, by keeping filter bag 306 from being in direct contact with pump 202 filter bag 306 is protected from being damaged by pump 202.

Spring loaded door 308 is a flap with a spring mechanism that is located at the intake opening of pivot mount 132. Spring loaded door 308 operates to ensure a one-way flow through the body chamber 120 during use and prevents debris from reentering back into the pool. Spring loaded door 308 may close when pool cleaner 100 is not in operation, trapping the debris within dirt tray 126. Spring loaded door 308 acts as (and may be considered) a one-way valve. When pump 202 is turned on, the pressure created by pump 202 opens spring loaded door 308, allowing water to flow through the filters. When pump 202 is turned off spring loaded door 308 closes as a result of a spring pushing spring loaded door 308 closed.

Spring 310 is the spring that mechanically biases spring loaded door 308 to stay in the closed position.

Figure 4:
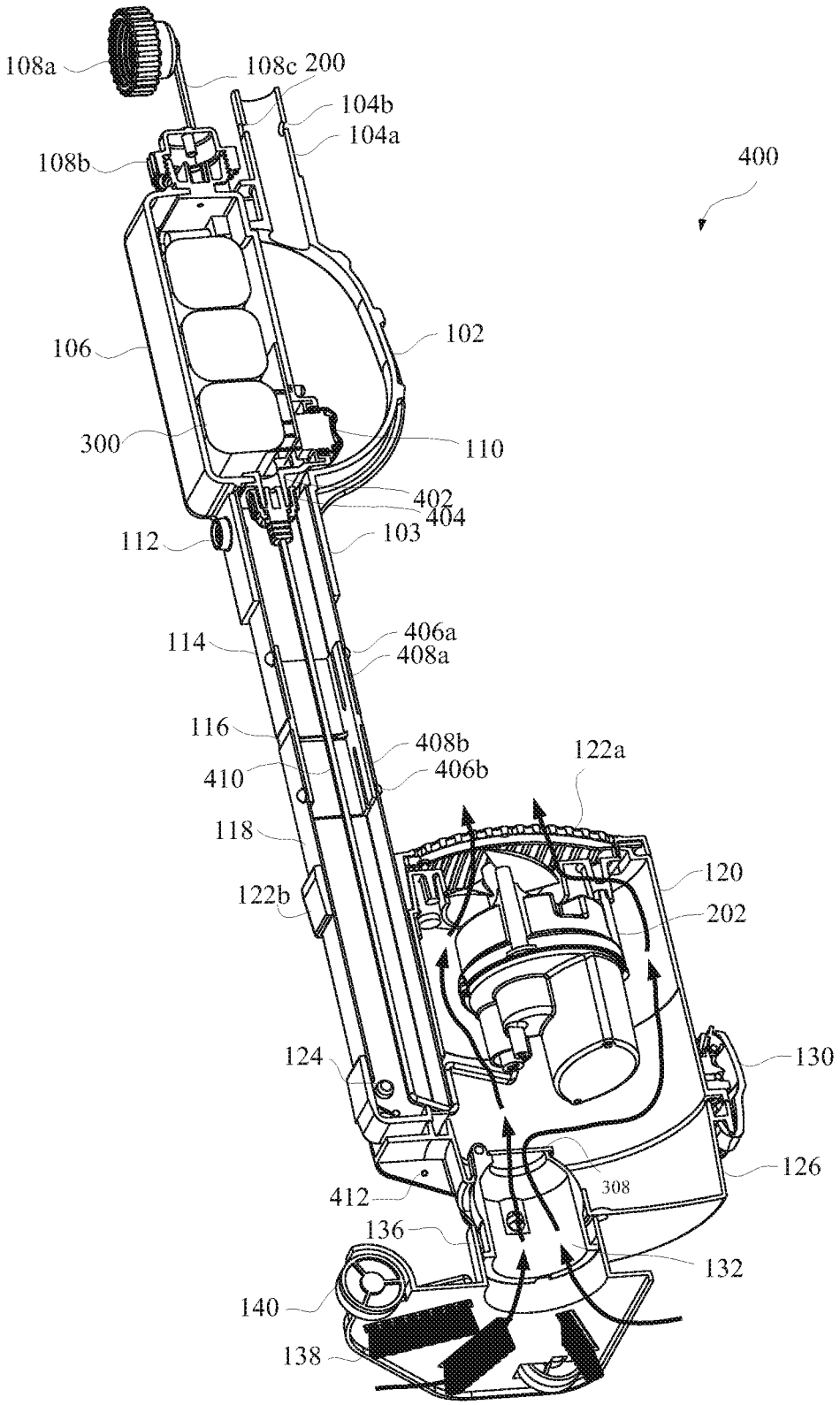
FIG. 4 shows another view of an embodiment of the pool cleaner of FIG. 1 without the filters, without the cage surrounding the pump and without the rigid mesh that supports the fine filter, to illustrate the direction of flow of water through the pool cleaner.

FIG. 4 shows a view 400 of an embodiment of pool cleaner 100. FIG. 4 includes handle 102, handle socket 103, pole connector 104*a*, hole 104*b*, power pack 106, electrical caps 108*a* and 108*b*, connector 108*c*, on/off switch 110, bracket screws 112, handle connector 114, link 116, body connector 118, body chamber 120, discharge cover 122*a*, brace 122*b*, fastener 124, dirt tray 126, latch 130, pivot mount 132, vacuum head 136, bristles 138, wheels 140, pump 202, battery blocks 300, and spring loaded door 308, electrical socket 402, connector 404, buttons 406*a* and 406*b*, levers 408*a* and 408*b*, power cord 410, and hole 412. In other embodiments, pool cleaner 100 may not have all of the components listed above or may have other components instead of and/or in addition to those listed above.

FIG. 4 shows view 400 of an embodiment of pool cleaner 100 without pump cage 204, without rigid mesh 206, without filter bag 306, and without a mesh filter, so that the flow of water within the portable cleaner 100 is easier to see. FIG. 4 depicts the location of the pump within body chamber 120 and the flow of water through body chamber 120.

Electrical socket 402 is located on power pack 106. Electrical socket 402 is used for transmitting power from the battery blocks 300 of power pack 106 to the motor 304. The batteries of battery blocks 300 may be connected in series between two electrical leads in electrical socket 402. In an embodiment, electrical socket 402 has screw threads on the outer surface of electrical socket for hermetically engaging an electrical connector to a power cord.

Connector 404 is an electrical connector that engages electrical socket 402. Connector 404 has screw threads that engage the screw threads on electrical socket 402, forming a hermetic seal, and may include leads that make electrical contact with leads in electrical socket 402. Buttons 406*a* and 406*b* are located on link 116. Buttons 406*a* and 406*b* fits through a holes in handle connector 114 and body connector 118 to secure handle connector 114 and body connector 118 to link 116. Levers 408*a* and 408*b* are resiliently flexible, and provide a mechanical bias pushing buttons 406*a* and 406*b* through corresponding holes in handle connector 114 and body connector 118. By pressing on buttons 406*a* and 406*b* (against the mechanical bias provided by levers 408*a* and 408*b*), handle connector 114 and body connector 118 may be detached from link 116.

Power cord 410 is an insulated electrical cord that connects, via electrical socket 402 and connector 404, to battery blocks 300 within power pack 106 to pump 202. Power cord 410 transmits the electricity from power pack 106 to pump 202 when on/off switch 110 is flipped on. Power cord 410 may be housed within the hollow portion of handle connector 114, small connector 116, and body connector 118. In an embodiment, power cord 410 may connect to pump 202 through an opening on the side of body chamber 120. In an embodiment, the electrical connections between power cord 410 and battery blocks 300 and between power cord 410 and pump 202 are hermetically sealed.

As illustrated by the arrows within body chamber 120, during operation, the water from the pool flows through the intake opening of vacuum head 136, through pivot mount 132, into body chamber 120. Subsequently, the water, after being filtered, flows around pump 202, and out of body chamber 120 through the discharge opening covered by discharge cover 122*a*.

Hole 412 is located in a tab below socket 123 on body chamber 120 accepts dirt tray pivot 128. The other half body chamber 120 has a similar tab below socket 123 with a similar hole for dirt tray pivot 128. Holes 412 align with the holes in the dirt tray 126 when dirt tray pivots 128 are inserted into the aligned holes to form a hinge connecting dirt tray 126 and chamber body 120.

Figure 5:
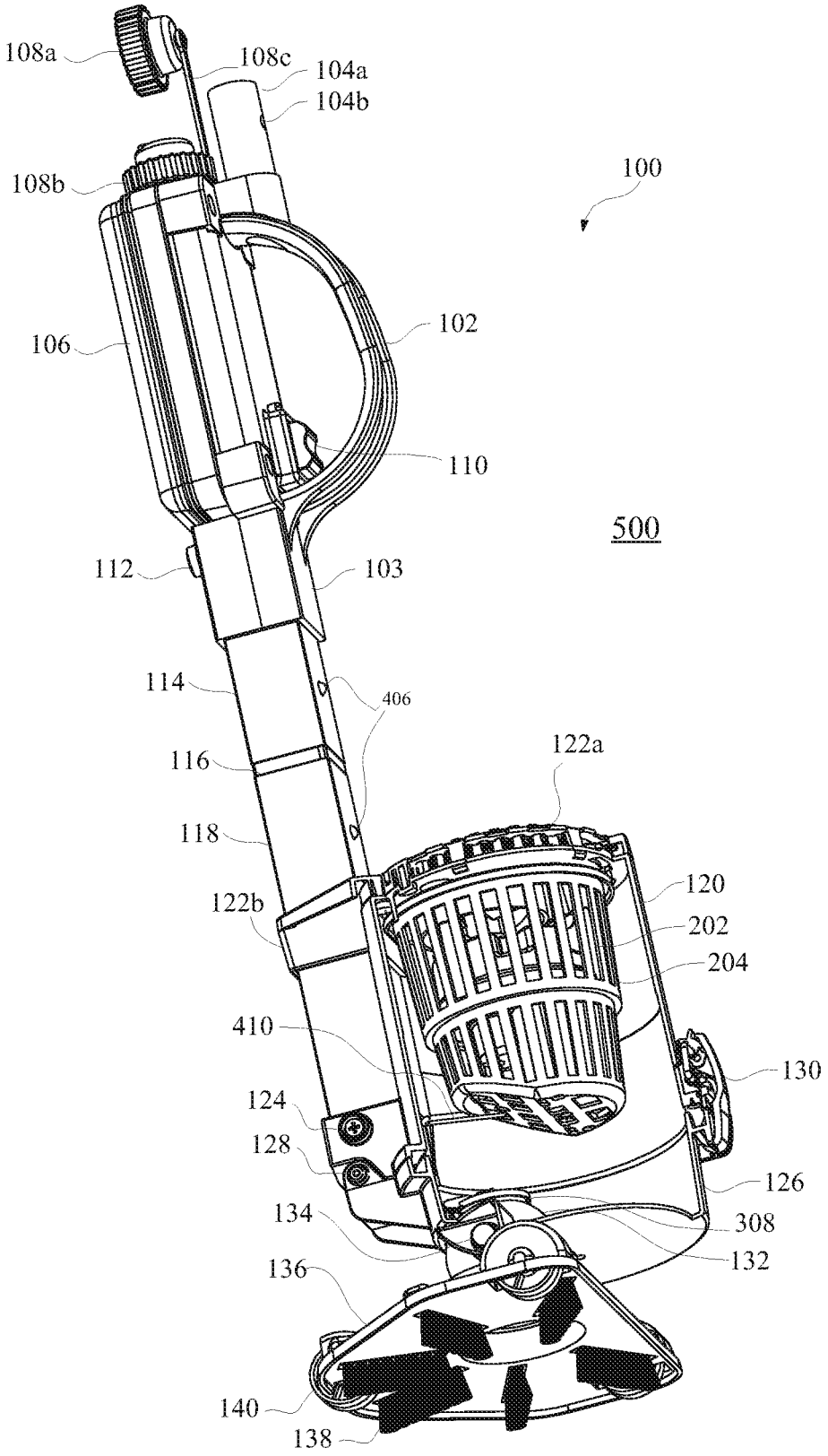
FIG. 5 shows another view of an embodiment of the pool cleaner of FIG. 1 without the filters and without the rigid mesh supporting the filter.

FIG. 5 shows a view of an embodiment 500 of body chamber 120 of pool cleaner 100. FIG. 5 includes handle 102, handle socket 103, pole connector 104*a*, hole 104*b*, power pack 106, electrical caps 108*a* and 108*b*, cap connector 108*c*, on/off switch 110, bracket screws 112, handle connector 114, link 116, body connector 118, body chamber 120, discharge cover 122*a*, fastener 124, dirt tray 126, dirt tray pivot 128, latch 130, pivot mount 132, pivot cover 134, vacuum head 136, bristles 138, wheels 140, pump 202, pump cage 204, spring loaded door 308, buttons 406*a* and 406*b*, and power cord 410. In other embodiments, pool cleaner 100 may not have all of the components listed above or may have other components instead of and/or in addition to those listed above.

FIG. 5 shows a view 500 of an embodiment of body chamber 120 of pool cleaner 100 without the rigid mesh 206, filter bag 306, and a mesh filter installed. FIG. 5 provides another view of body chamber 120, demonstrating how the pump 202 and pump cage 204 fit within body chamber 120. In the embodiment of FIG. 5, cord 410 runs from body connector 118 into body chamber 120, through the bottom of pump cage 204 to pump 202.

Figure 6:
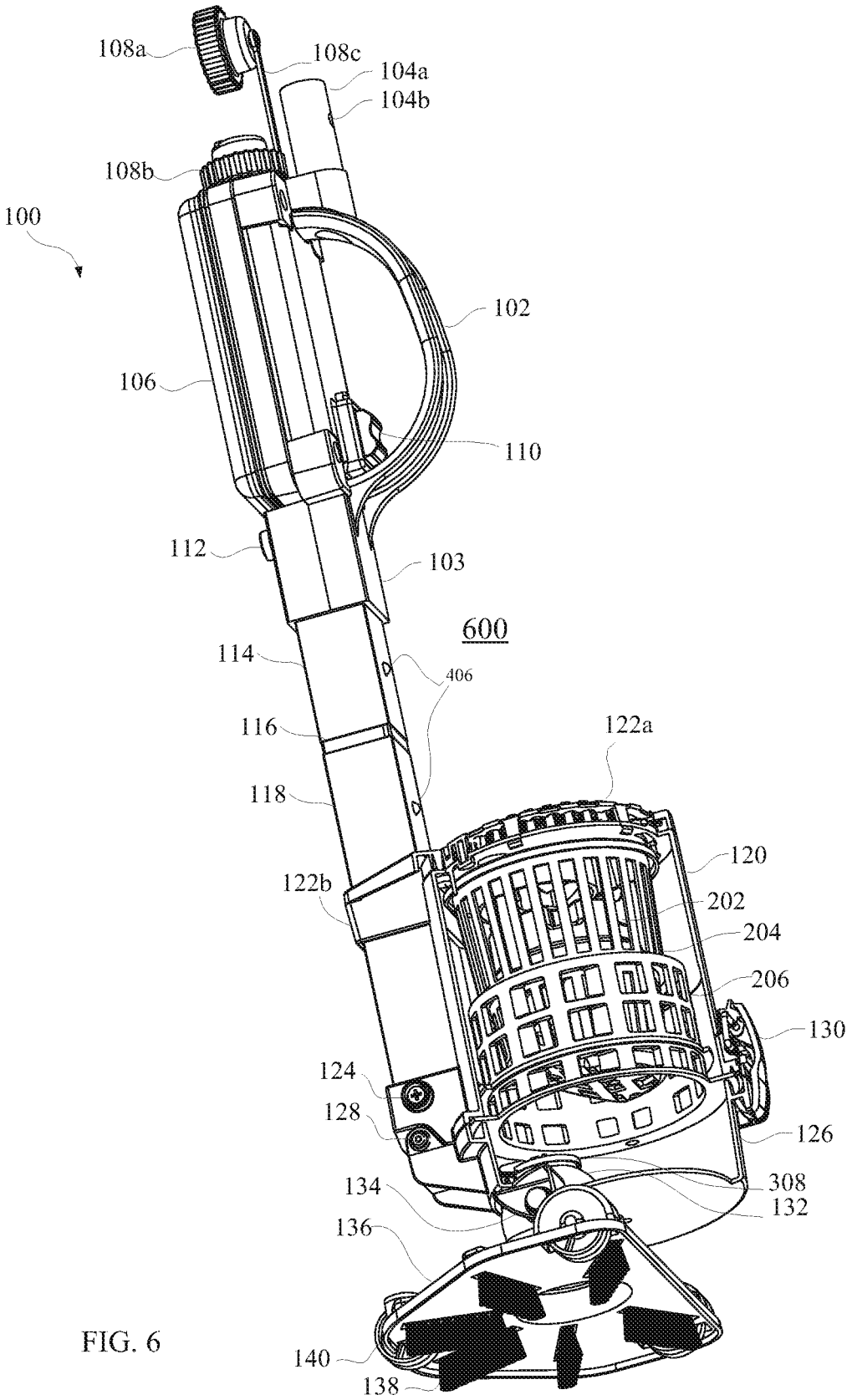
FIG. 6 shows a view of an embodiment of the body chamber of the pool cleaner of FIG. 1 without the dirt tray and without the filters.

FIG. 6 shows a view 600 of an embodiment of body chamber 120 of pool cleaner 100. FIG. 6 includes handle 102, handle socket 103, pole connector 104*a*, power pack 106, electrical caps 108*a* and 108*b*, cap connector 108*c*, on/off switch 110, bracket screws 112, handle connector 114, link 116, body connector 118, body chamber 120, discharge cover 122*a*, brace 122*b*, fastener 124, dirt tray 126, dirt tray pivot 128, latch 130, pivot mount 132, pivot cover 134, vacuum head 136, bristles 138, wheels 140, pump 202, pump cage 204, rigid mesh 206, and spring loaded door 308. In other embodiments, pool cleaner 100 may not have all of the components listed above or may have other components instead of and/or in addition to those listed above.

FIG. 6 provides another view 600 of body chamber 120, demonstrating how pump 202, pump cage 204, and rigid mesh 206 fit within body chamber 120. FIG. 6 shows a view of an embodiment of body chamber 120 of pool cleaner 100 without filter bag 306 and without a mesh filter installed. In the embodiment of FIG. 6, the rim of rigid mesh 206 rests on the rim of dirt tray 126 and the rim of rigid mesh 206 is sandwiched between the rim of body chamber 120 and the rim of dirt tray 126. In the embodiment of FIG. 6, the rim of rigid mesh 206 is solid and has no holes, preventing water from flowing through the rim of rigid mesh 206. By preventing water form flowing through the rim of rigid mesh 206, the water is forced to flow through the intake opening of rigid mesh 206, into the filter bag 306 (FIG. 3).

Pump and Filters Assembly

Figure 7A:
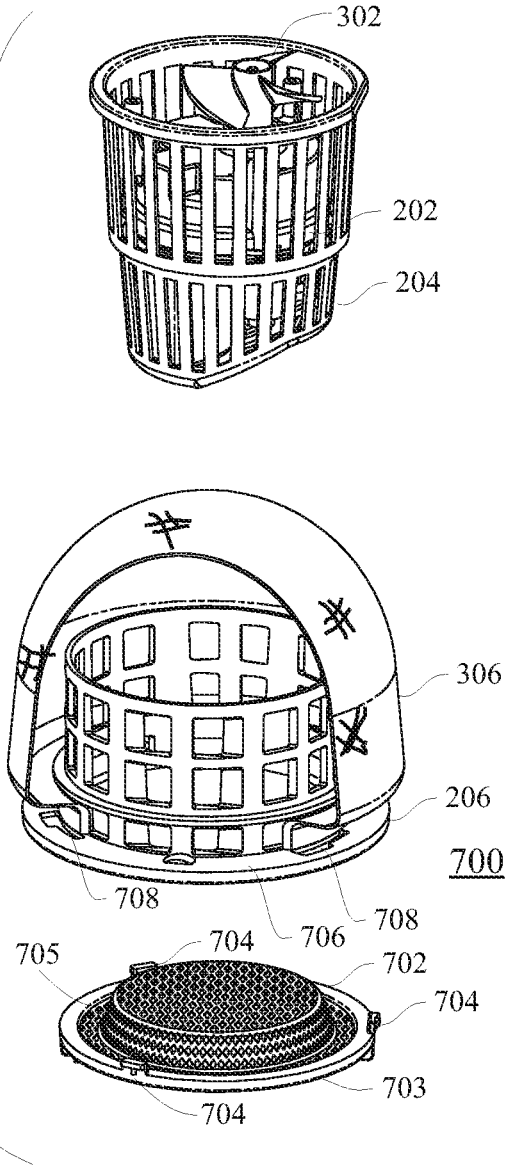
FIG. 7A is an exploded view of an embodiment of an assembly having the filters and the pump used in the pool cleaner of FIG. 1.
Figure 7B:
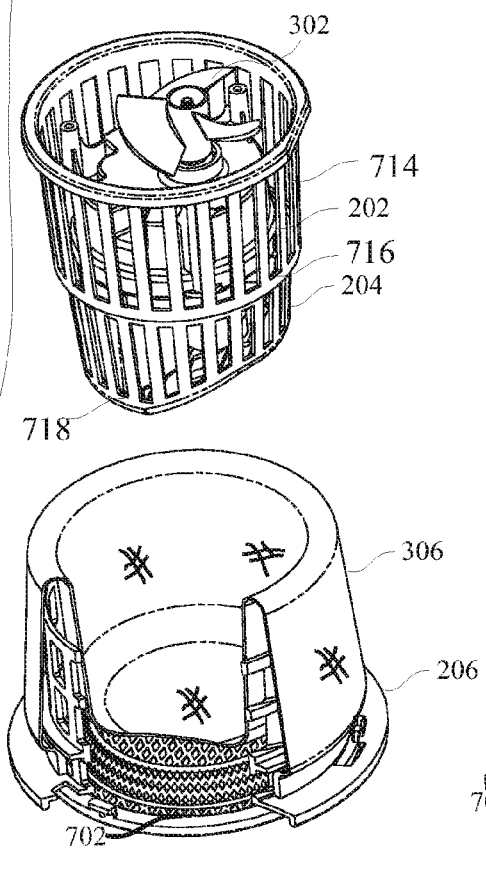
FIG. 7B shows the assembly of FIG. 7A after the filters have been secured to the rigid mesh that supports the filters.
Figure 7C:
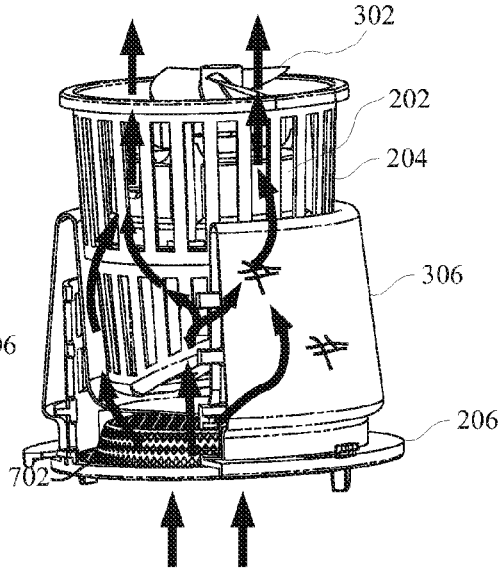
FIG. 7C shows the flow of water through assembly of 7B after the pump and pump cage are inserted into the rigid mesh with the filters attached.

FIG. 7A-C show side perspective views of an embodiment of an assembly 700 having pump 202, pump cage 204, rigid mesh 206, filter bag 306, and mesh filter 702, rim 703, tabs 704, mesh 705, rim 706, slots 708, upper portion 714, shelf 716, and lower portion 718 that may be used in pool cleaner 100, and the views also show how the components fit together. In other embodiments, the assembly 700 may not have all of the components listed above or may have other components instead of and/or in addition to those listed above. Upper portion 714, shelf 716, and lower portion 718 are shown and discussed, below, in conjunction with FIG. 7B.

FIG. 7A shows the attaching of filter bag 306 to rigid mesh 206. FIG. 7A is an exploded view of an embodiment of an assembly 700 having the filters and the pump used in the pool cleaner of FIG. 1. Filter bag 306 is attached near the base of rigid mesh 206. Mesh filter 702 is a coarse filter that fits in between the discharge end of dirt tray 126, and body chamber 120 and covers one end of rigid mesh 206. Mesh filter 702 may be rigid. Mesh filter 702 may prevent large pieces of debris from entering into body chamber 120, thereby trapping the large debris within dirt tray 126. Preventing large pieces of debris from entering body chamber 120, prevents filter bag 306 from getting clogged and/or damaged by the larger pieces of debris. Mesh filter 702 fits into and engages with the bottom of rigid mesh 206. Pump cage 204 (housing pump 202) fits into rigid mesh 206.

Rim 703 is the rim of mesh filter 702. Tabs 704 are tabs located on rim 703 for attaching mesh filter 702 to the bottom of rigid mesh 206. Mesh 705 is a mesh for filtering large pieces of dirt from the water prior to the water passing to the fine filter. Optionally, mesh 705 may include raised portion that fits into the intake opening of rigid mesh 206. Rim 706 is the rim of rigid mesh 206. Slots 708 are located in rim 706, and receive tabs 704. Tabs 704 engage slots 708 to hold mesh filter 702 to the bottom of rigid mesh 206, so that water entering the intake opening of rigid mesh 206 must first pass through mesh filter 702.

FIG. 7B shows the filter bag 306 after the filter bag 306 has been tucked into the rigid mesh 206, so as to line the inside and outside of rigid mesh 206 and receive pump 202 and pump cage 204. FIG. 7B shows the assembly of FIG. 7A after the filter bag 306 and mesh filter 702 have been secured to the rigid mesh 206 that supports the filter bag 306. In FIG. 7 B, filter 702 has been attached to the bottom of rigid mesh 206. In another embodiment, rim 708 does not have any slots or holes and mesh filter 702 does not have tabs 704. Instead, mesh filter 702 rests on top of dirt tray 126. For example, mesh filter 702 may rest on, or on the rim of, dirt tray 126 or just within the rim of dirt tray 126.

Upper portion 714 is the upper portion of pump cage 204. Shelf 716 divides upper portion 714 from the lower portion of pump cage 204. Lower portion 718 is the lower portion of pump cage 204. Lower portion 718 is smaller and narrower than upper portion 714. In an embodiment pump cage 204 may hang from the bottom of pump 202 and extend up and surround pump 202.

FIG. 7C depicts how the components of the assembly fit together and how the water flows through the assembly. FIG. 7C shows the flow of water through assembly of 7B after the pump and pump cage are inserted into the rigid mesh with the filters attached. Pool water exiting from the dirt tray may flow through mesh filter 702 (where larger pieces of debris are removed), through filter bag 306 (removing finer pieces of debris), through pump cage 204, and then out of body chamber 120.

Spring Loaded Door

Figure 8:
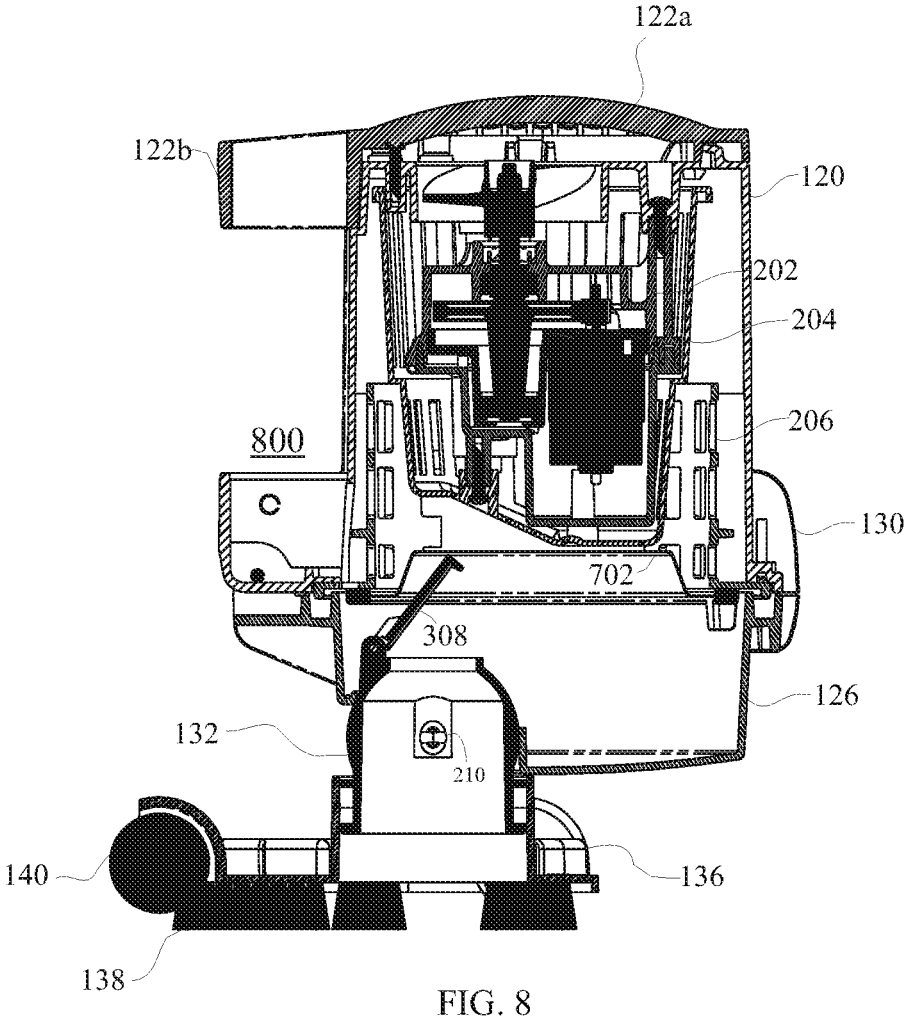
FIG. 8 shows a cross-sectional view of an embodiment of an assembly of the pool cleaner of FIG. 1 without the handle portion.

FIG. 8 shows a cross-sectional view of an embodiment of an assembly 800 of body chamber 120, pivot mount 132, and vacuum head 136 that may be used in pool cleaner 100. FIG. 8 includes body chamber 120, discharge cover 122*a*, brace 122*b*, dirt tray 126, latch 130, pivot mount 132, vacuum head 136, bristles 138, wheels 140, pump 202, pump cage 204, rigid mesh 206, spring loaded door 308, mesh filter 702. In other embodiments, the assembly 800 may not have all of the components listed above or may have other components instead of and/or in addition to those listed above.

FIG. 8 provides another view of body chamber 120, demonstrating how pivot mount 132 and spring loaded door 308 fit together and interact with the flowing water entering into dirt tray 126 and body chamber 120. When pool cleaner 100 is in operation, the hydraulic pressure of water flowing out of body chamber 120 may cause spring-loaded door 308 to open, allowing water to flow from pivot mount 132 into dirt tray 126. The raised portion of mesh filter 702 accommodates spring loaded door 308, allowing spring loaded door to open into the space created by and under the raised portion.

Figure 9:
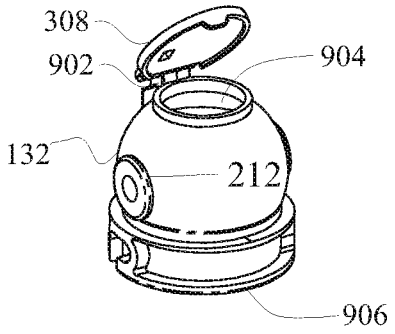
FIG. 9 shows a side perspective view of an embodiment of a pivot mount that may be used in the pool cleaner of FIG. 1.

FIG. 9 shows a side perspective view of an embodiment of pivot mount 132 that may be used in pool cleaner 100. FIG. 9 includes pivot mount 132, spring loaded door 308, hinge 902, discharge opening 904, and intake opening 906. In other embodiments, pivot mount 132 may not have all of the components listed above or may have other components instead of and/or in addition to those listed above.

Hinge 902 is a spring loaded hinge to pivotally attach spring loaded door 308 to one side of the discharge end of pivot mount 132. The spring of hinge 902 is the spring that makes spring loaded door 308 spring loaded. Hinge 902 may allow spring loaded door 308 to open while staying attached to pivot mount 132, when enough of a vacuum is created by pump 202 to push spring loaded door 308 open, despite being mechanically biased by the spring to stay closed. Spring loaded door 308 may be attached to the spring of hinge 902 to keep spring loaded door 308 closed when pool cleaner 100 is not in use. Discharge opening 904 allows water discharging from pivot mount 132 to discharge into the intake opening of dirt tray 126, to mesh filter 702. Intake opening 906 is the intake opening for pivot mount 132.

Quick Drain Door

Figure 10A:
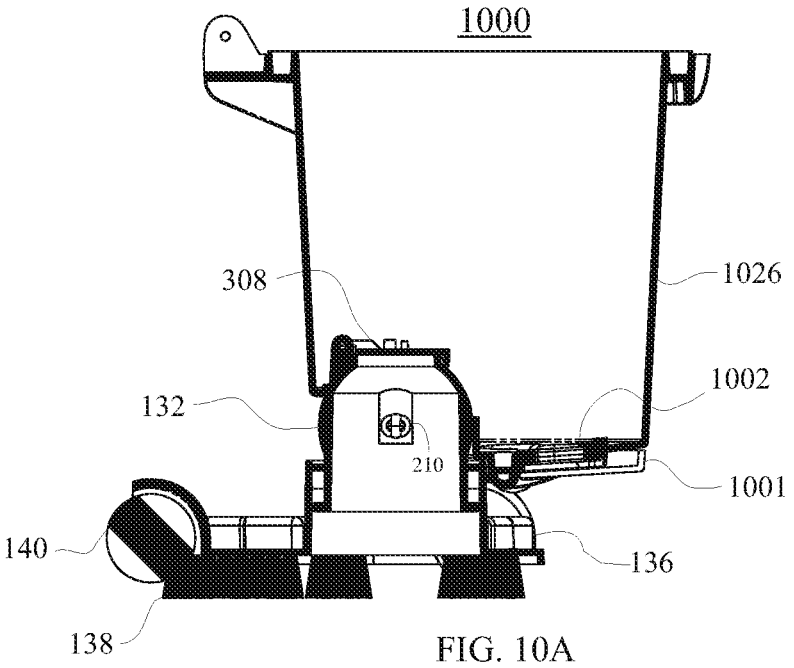
FIG. 10A shows cross-sectional view of an embodiment of an assembly of a bottom portion of the pool cleaner having a larger dirt tray than the embodiment of FIG. 1, and pivot mount in which a quick release door is closed.
Figure 10B:
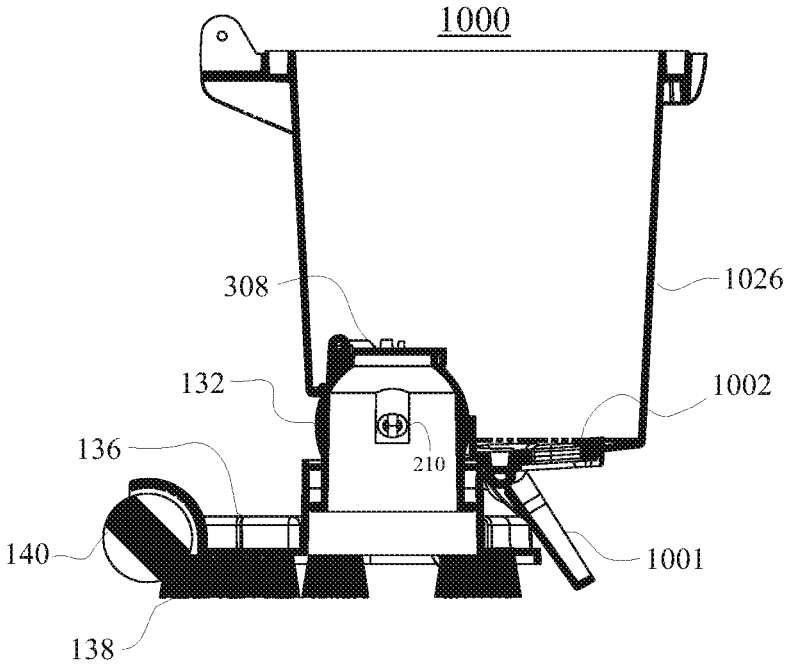
FIG. 10B shows cross-sectional view of an embodiment of the assembly FIG. 10A, in which a quick release door is open.

FIGS. 10A and 10B show cross-sectional views of an embodiment of an assembly 1000 of pivot mount 132, and vacuum head 136 that may be used in pool cleaner 100. FIGS. 10A and 10B include, pivot mount 132, vacuum head 136, bristles 138, wheels 140, spring loaded door 308, quick drain door 1001, screen 1002, and dirt tray 1026. In other embodiments, the assembly 1000 may not have all of the components listed above or may have other components instead of and/or in addition to those listed above.

In FIG. 10A, assembly 1000 includes the bottom portion of the pool cleaner 100 having a larger dirt tray than dirt tray 126 of the embodiment of FIG. 1. In the view of FIG. 10A, the quick release door is closed. FIG. 10B shows cross-sectional view of an embodiment of the assembly 1000, in which the quick release door is open.

Pivot mount 132, vacuum head 136, bristles 138, wheels 140 and spring loaded door 308 were described above in conjunction with FIG. 1.

Because of the excess water buildup due to the buildup of debris, an easy method of releasing the water from body chamber 120 and the dirt tray is provided. In this embodiment, the dirt tray has a second opening at the intake end, which is covered by a screen and a quick drain door. Quick drain door 1001 opens to allow water from the dirt tray to drain. The screen keeps debris from exiting the dirt tray while draining dirt tray 1026.

Quick drain door 1001 is a spring loaded flap that closes the second opening of the dirt tray when pool cleaner 100 is in use. The hydraulic pressure within dirt tray 126 and body chamber 120 keeps quick drain door 1001 closed. When the pool cleaner 100 is turned off and lifted out of the pool, the lack of hydraulic pressure within the dirt tray causes the water push open quick drain door 1001 and flow out of the dirt tray.

Screen 1002 is a screen that covers the second opening, preventing debris within the dirt tray from flowing back into the pool. Screen 1002 may be a fine or coarse filter. In an embodiment, screen 1002 is removable for easy replacement and cleaning Dirt tray 1026 is similar to dirt tray 126, except dirt tray 1026 is larger than dirt tray 126. Dirt tray 1026 includes quick drain door 1001 and screen 1002 to allow water in dirt tray 1026 to be emptied, so that it is easier to carry pool cleaner 100.

Figure 11A:
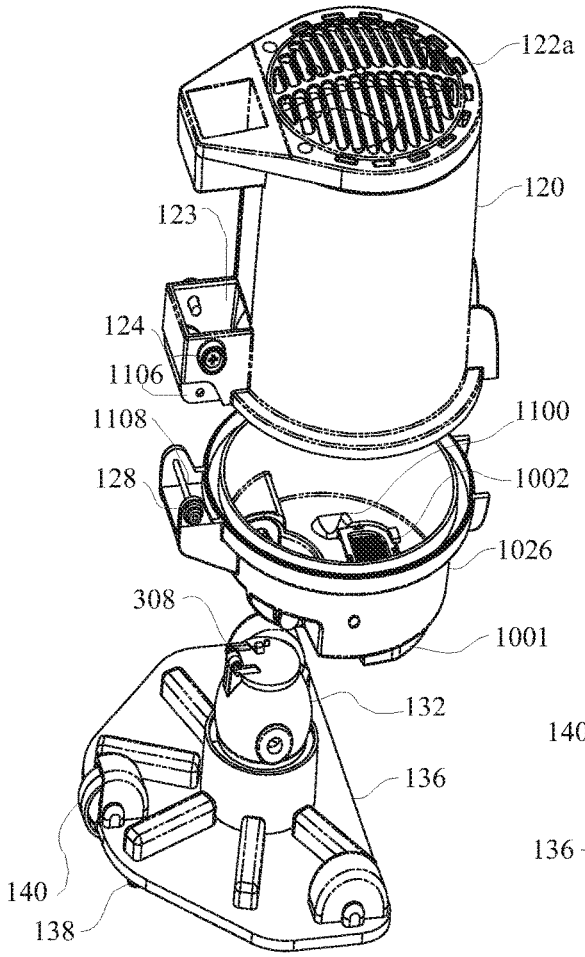
FIG. 11A shows an exploded view of the pool cleaner without the handle portion in which the ball head is attached to the vacuum head.
Figure 11B:
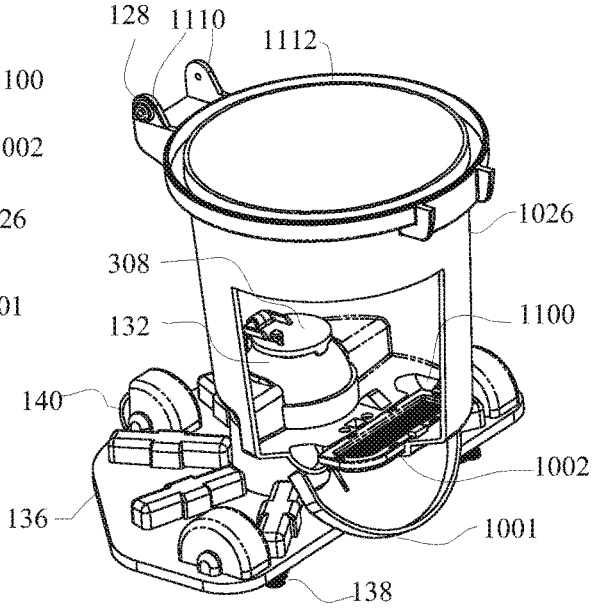
FIG. 11B shows essentially the assembly of FIG. 11A with the dirt tray attached to the vacuum head, but without the body chamber.
Figures 12A, 12B, 12C:
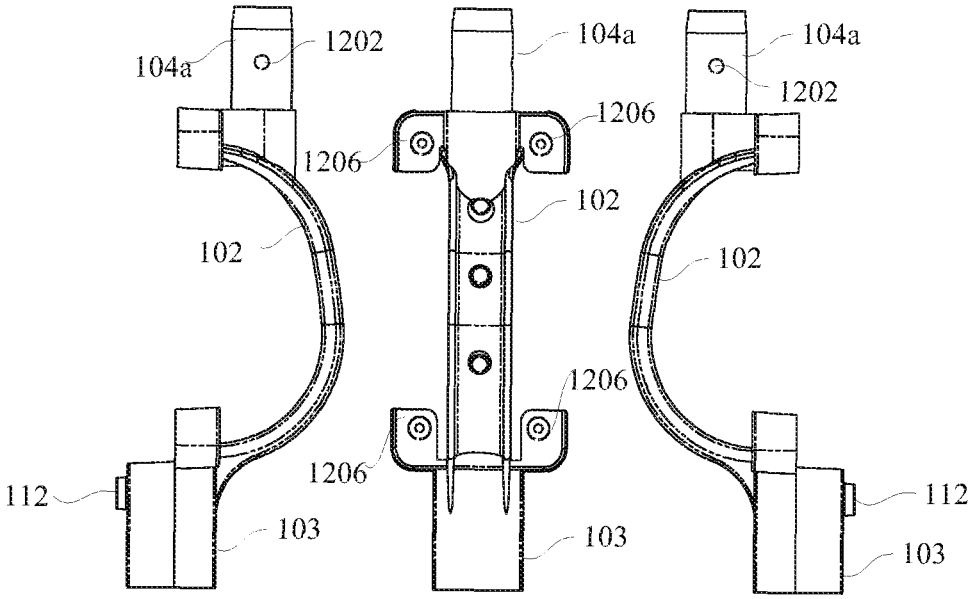
FIGS. 12A-E show different views of an embodiment of an assembly of the handle of the pool cleaner of FIG. 1.
Figure 12D:
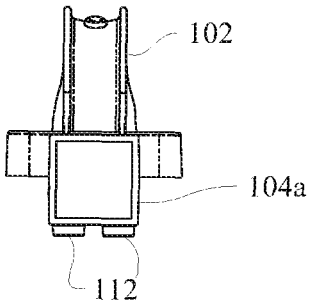
Figure 12E:
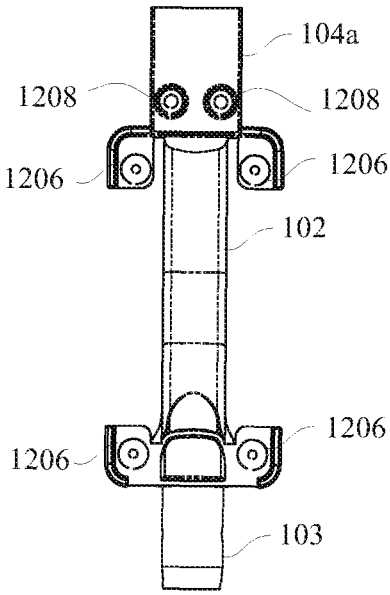
Figure 13A:
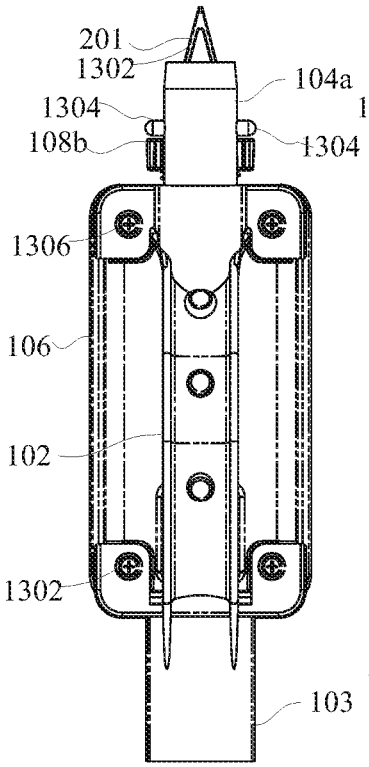
FIGS. 13A-E show different views of an embodiment of an assembly of a handle and power pack of the pool cleaner of FIG. 1.
Figure 13B:
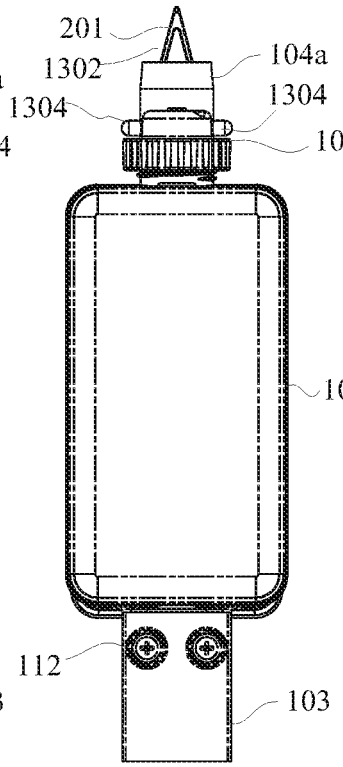
Figure 13C:
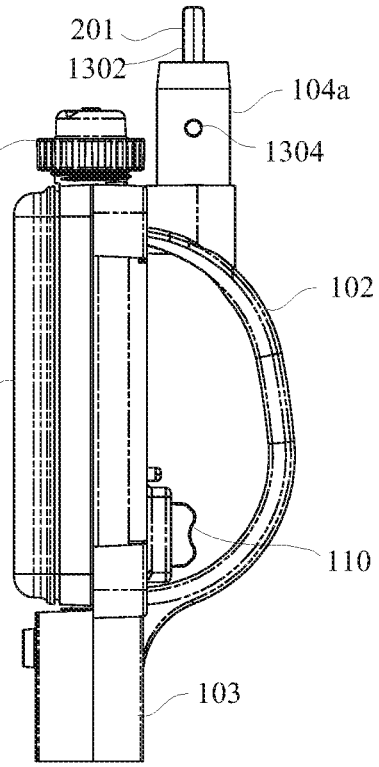
Figure 13D:
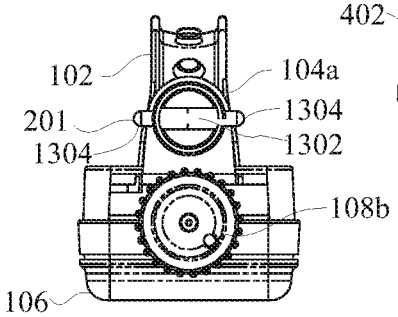
Figure 13E:
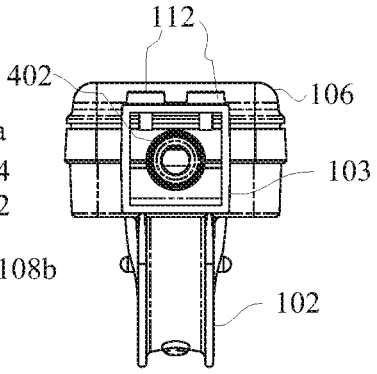
Figures 14A, 14B, 14C, 14D, 14E:
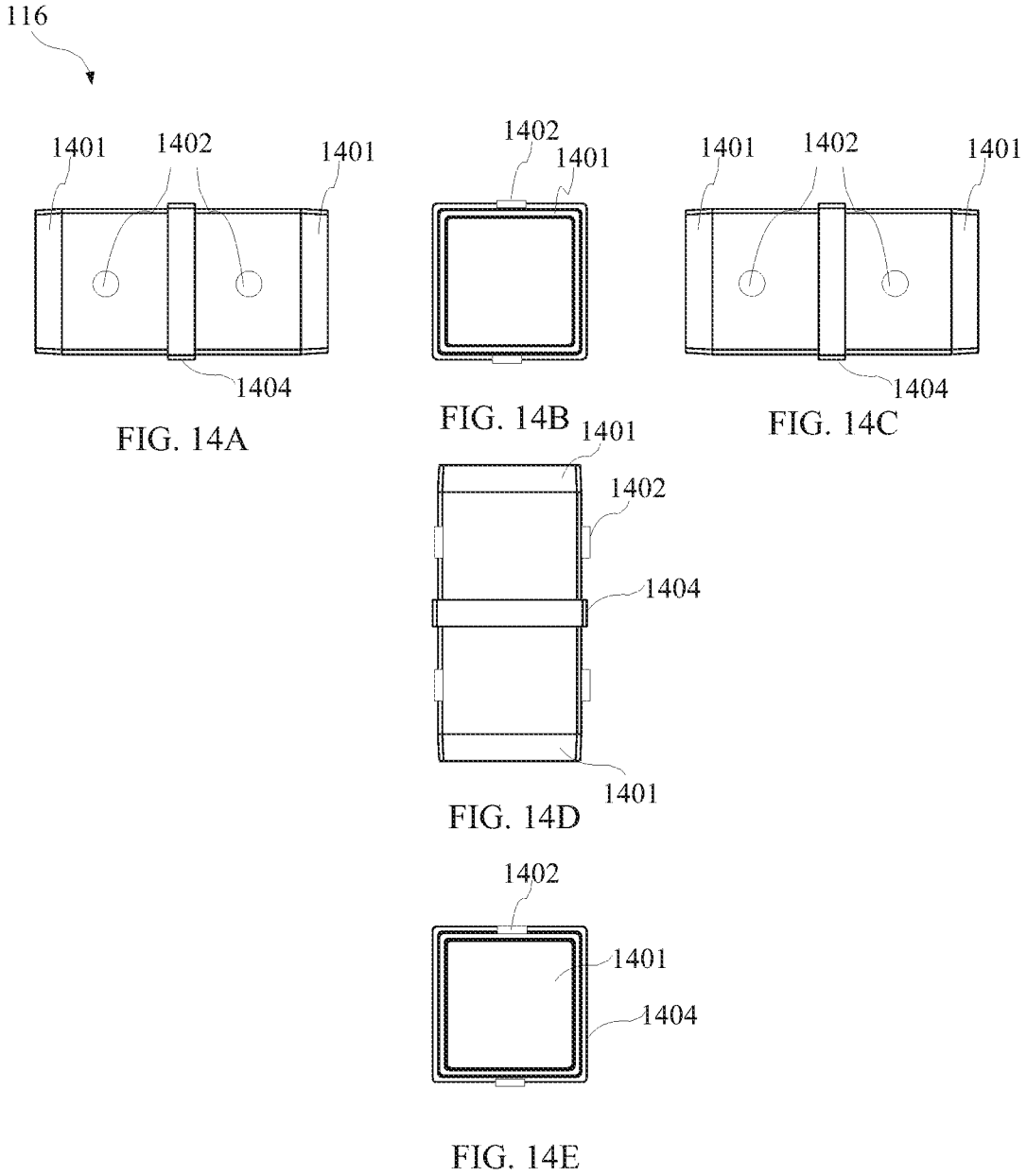
FIGS. 14A-E show different views of an embodiment of the link of the pool cleaner of FIG. 1.
Figure 15A:
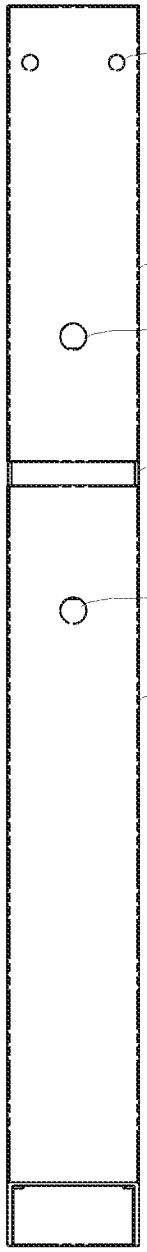
FIGS. 15A-D show different views of an embodiment of an assembly of connectors of the pool cleaner of FIG. 1.
Figure 15B:
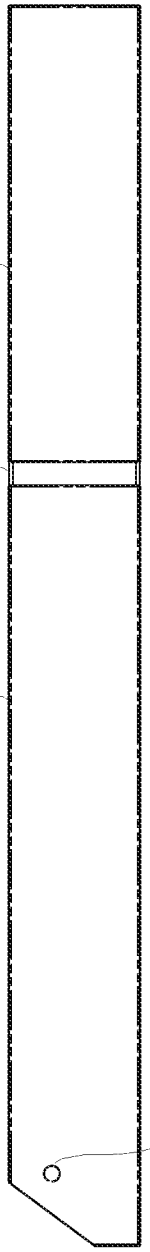
Figure 15C:
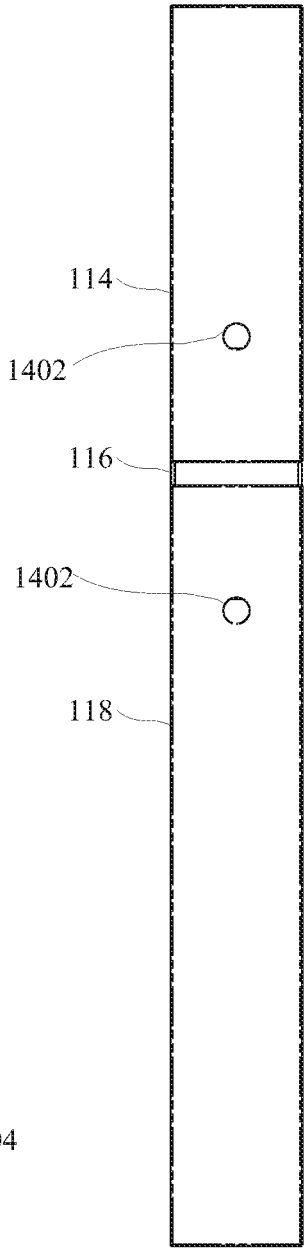
Figure 15D:
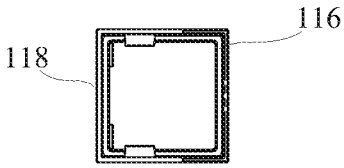
Figures 16A, 16B, 16C:
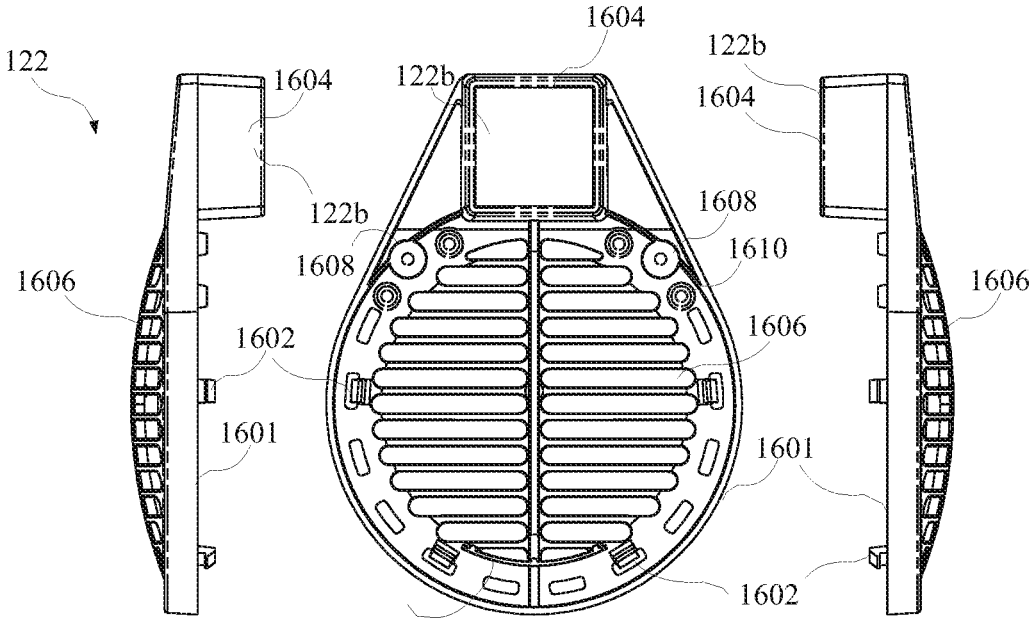
FIGS. 16A-E show different views of an embodiment of the discharge cover of the pool cleaner of FIG. 1.
Figure 16D:
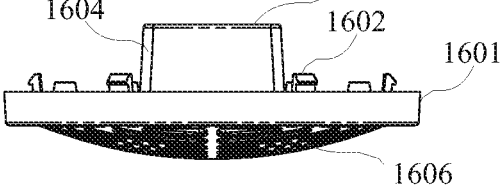
Figure 16E:
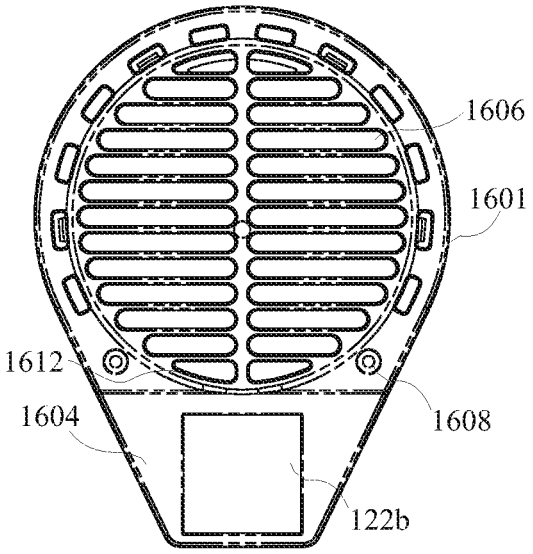
Figures 17A, 17B, 17C:
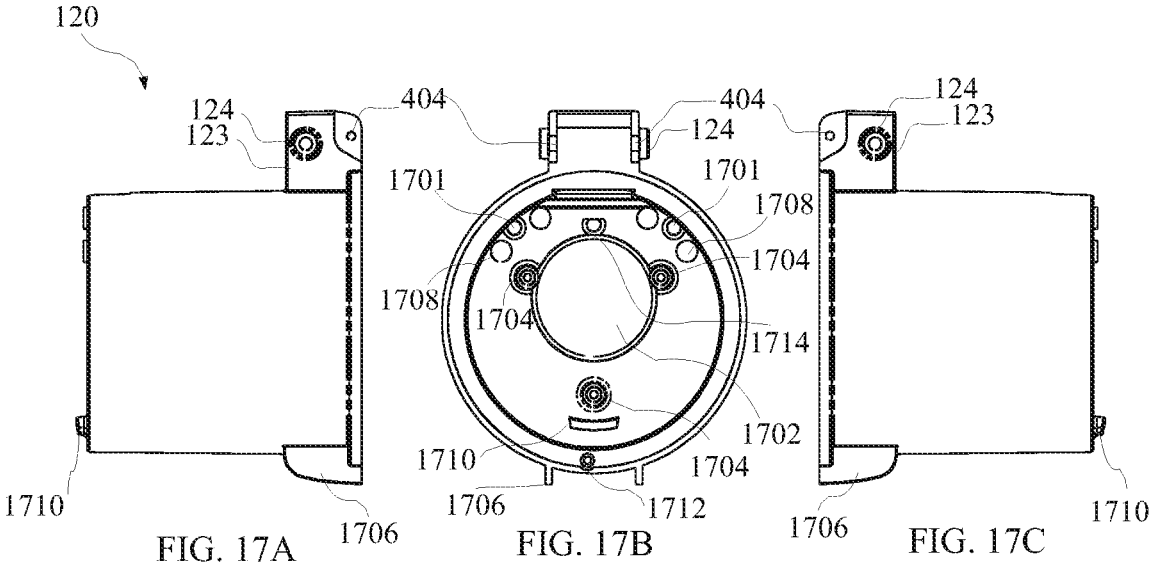
FIGS. 17A-E show different views of an embodiment of the body chamber of the pool cleaner of FIG. 1.
Figure 17D:
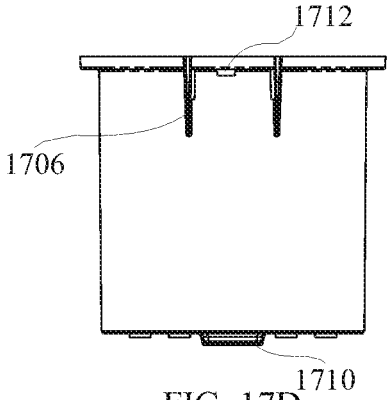
Figure 17E:
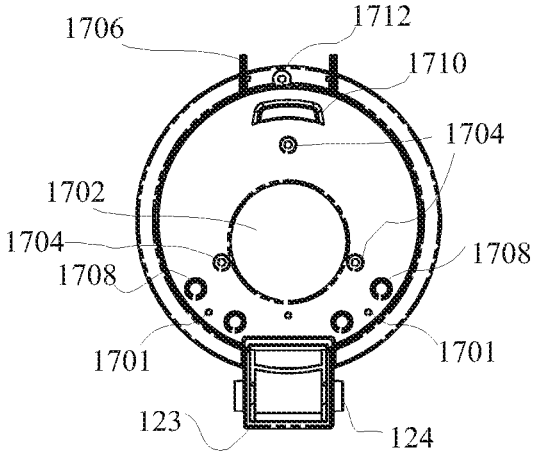
Figure 18A:
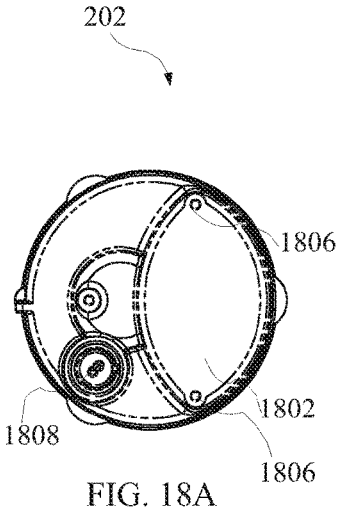
FIGS. 18A-E show different views of an embodiment of the pump of the pool cleaner of FIG. 1.
Figure 18B:
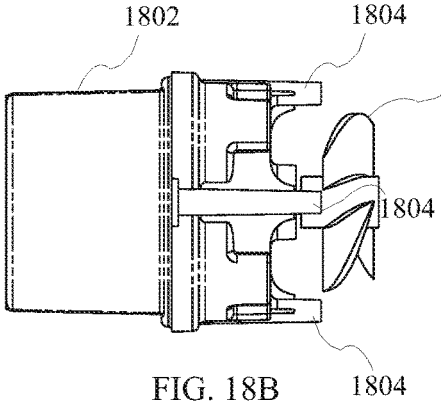
Figure 18C:
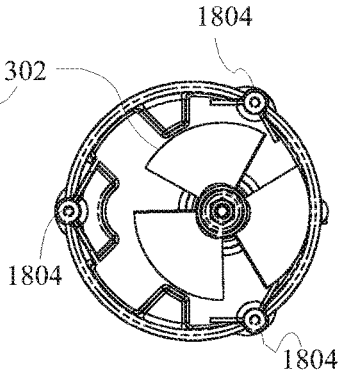
Figure 18D:
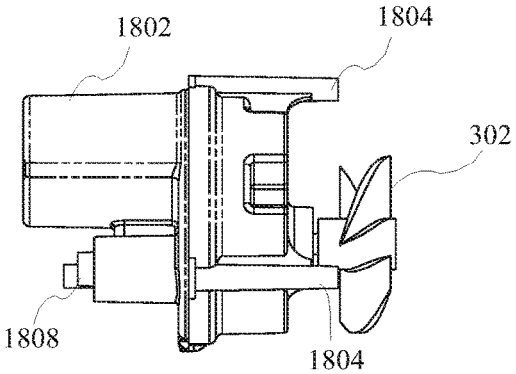
Figure 18E:
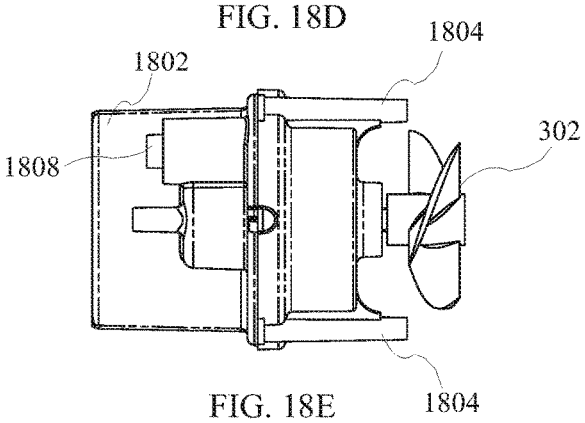
Figures 19A, 19B, 19C:
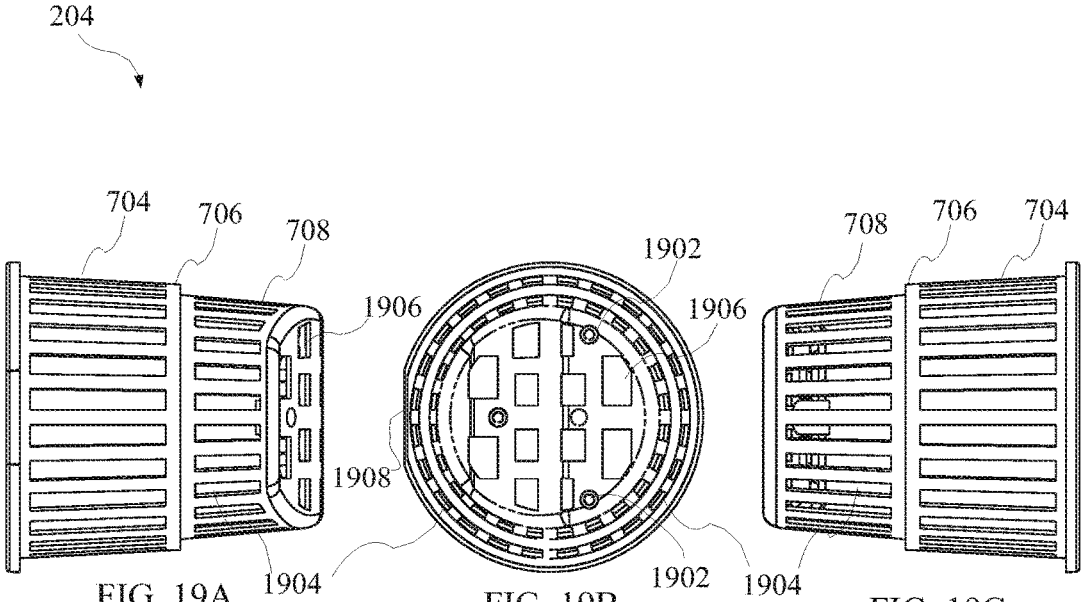
FIGS. 19A-E show different views of an embodiment of the empty pump cage of the pool cleaner of FIG. 1.
Figure 19D:
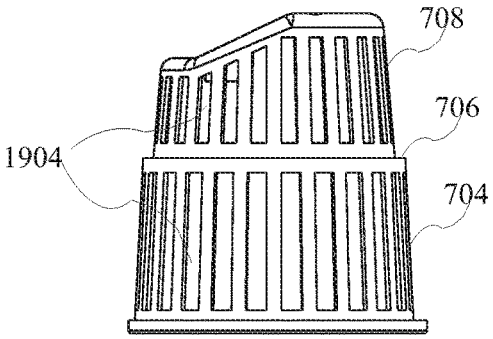
Figure 19E:
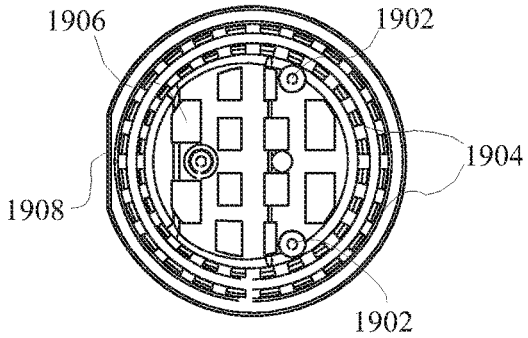
Figure 20A:
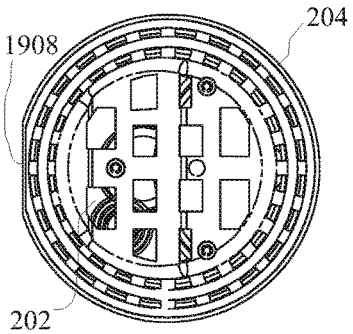
FIGS. 20A-E show different views of an embodiment of an assembly of the pump attached to the pump cage of the pool cleaner of FIG. 1.
Figure 20B:
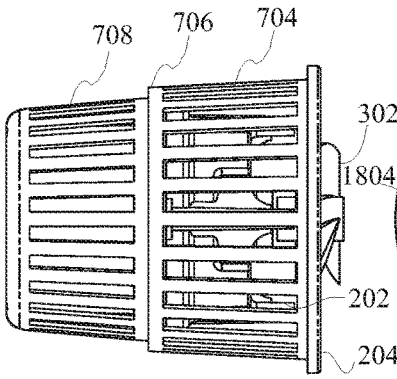
Figure 20C:
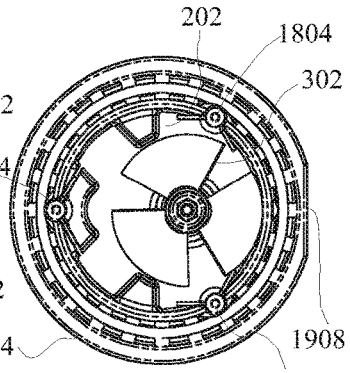
Figure 20D:
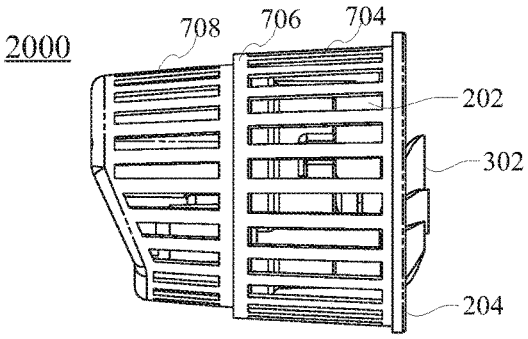
Figure 20E:
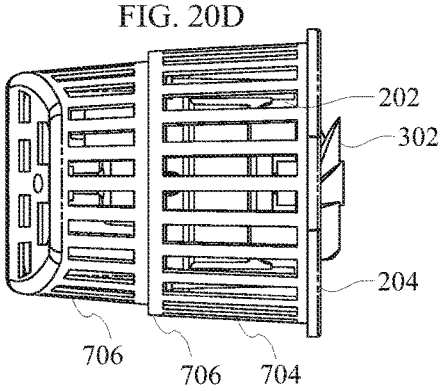
Figure 21A:
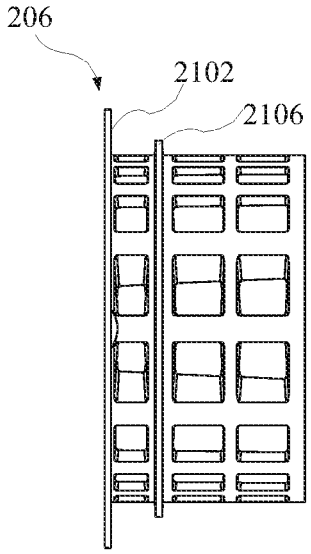
FIGS. 21A-E show different views of an embodiment of a rigid mesh that may be used in the pool cleaner of FIG. 1, which is different than the embodiment of the rigid mesh in FIG. 7A.
Figure 21B:
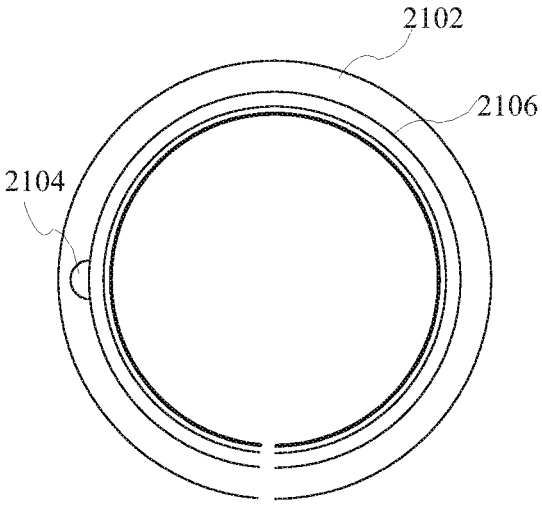
Figure 21C:
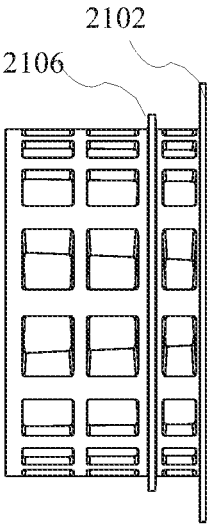
Figure 21D:
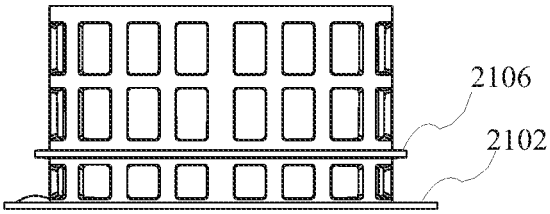
Figure 21E:
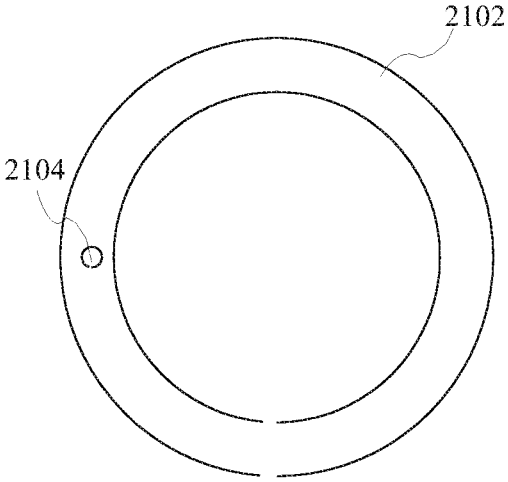
Figures 22A, 22B, 22C:
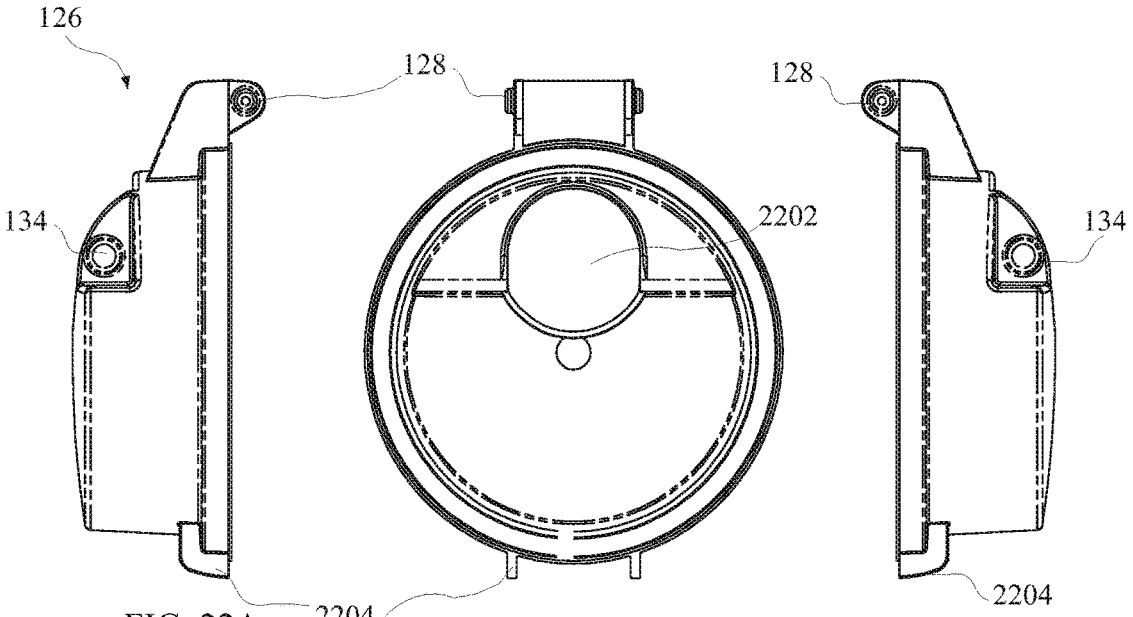
FIGS. 22A-E show different views of an embodiment of the dirt tray of the pool cleaner of FIG. 1.
Figure 22D:
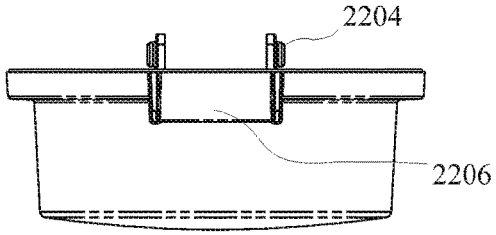
Figure 22E:
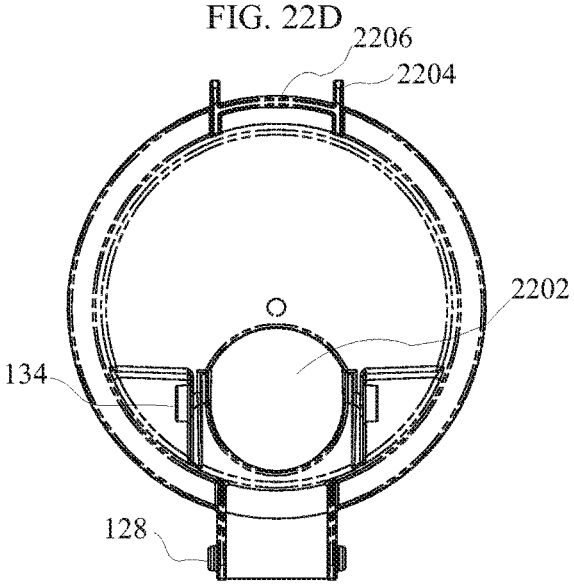
Figure 23A:
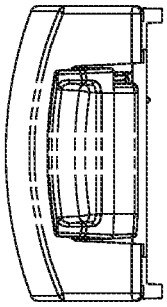
FIGS. 23A-E show different views of an embodiment of the locking latch that may be used in the pool cleaner of FIG. 1.
Figure 23B:
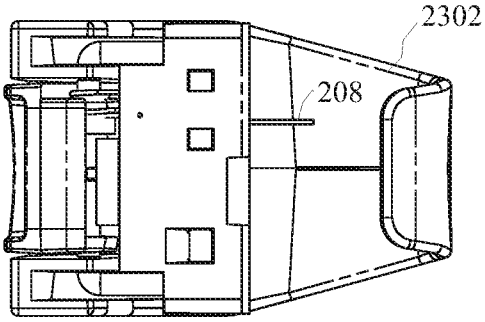
Figure 23C:
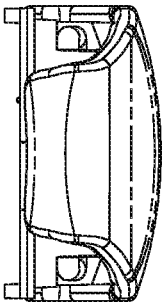
Figure 23D:
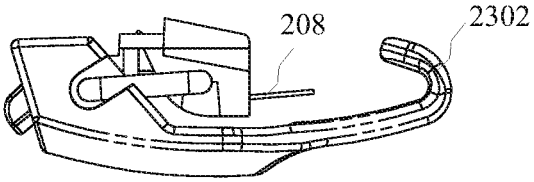
Figure 23E:
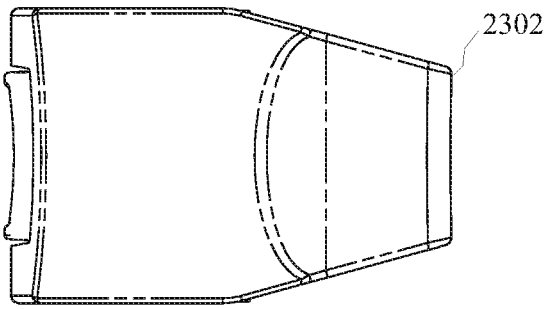
Figure 24A:
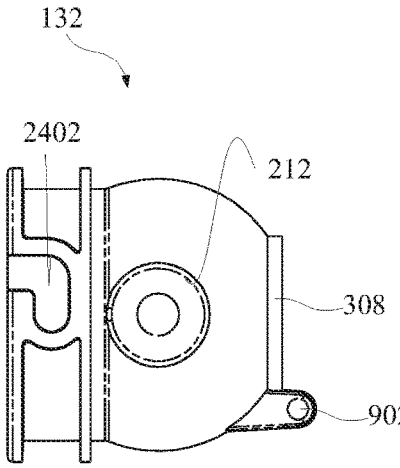
FIGS. 24A-E show different views of an embodiment of a pivot mount that may be used in the pool cleaner of FIG. 1.
Figure 24B:
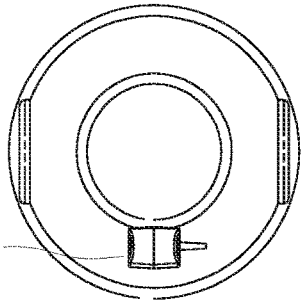
Figure 24C:
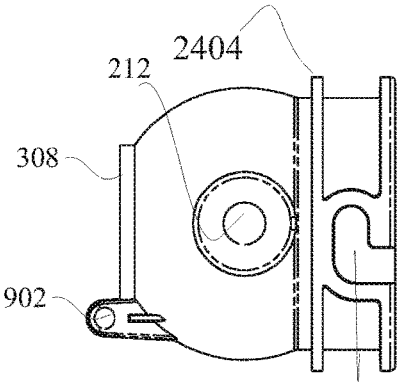
Figure 24D:
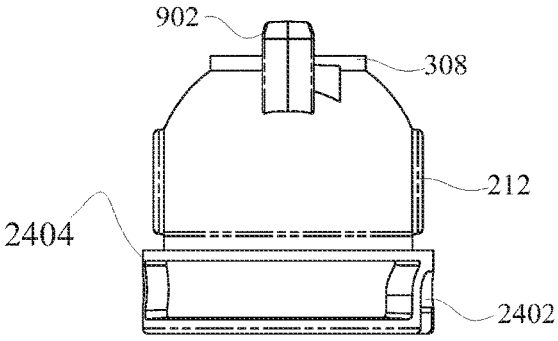
Figure 24E:
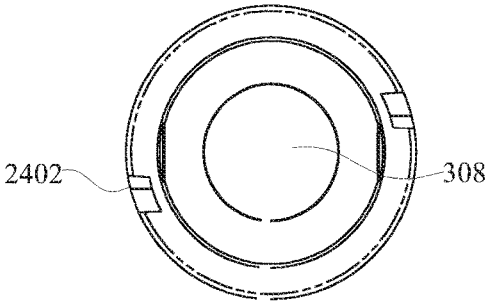
Figure 25A:
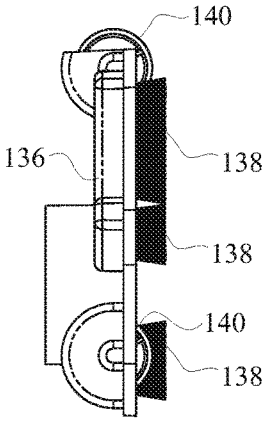
FIGS. 25A-E show different views of an embodiment of an assembly of vacuum head that may be used in the pool cleaner of FIG. 1.
Figure 25B:
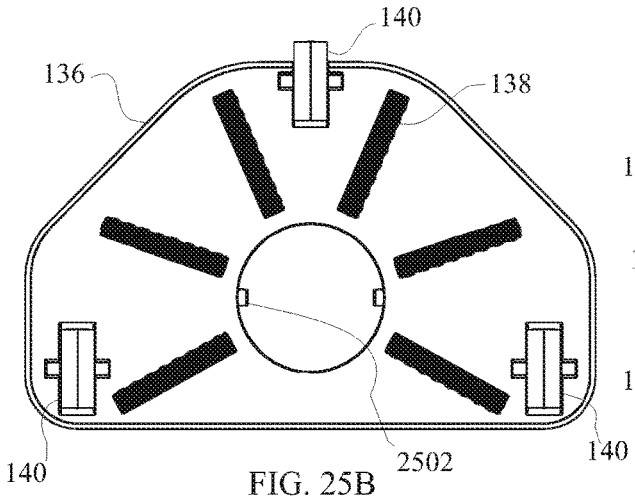
Figure 25C:
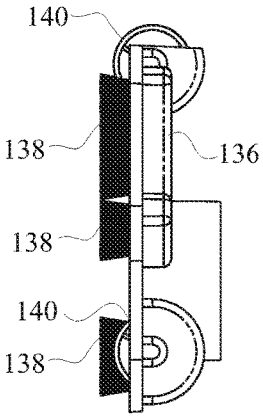
Figure 25D:
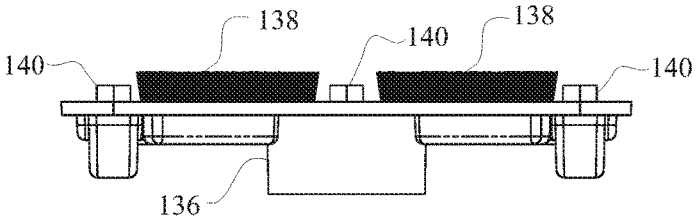
Figure 25E:
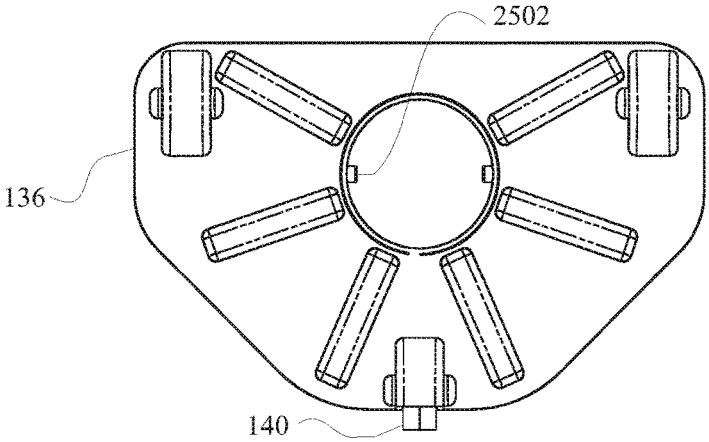

FIGS. 11A and 11B show side perspective views of the embodiment of an assembly 1000 of FIGS. 10A and 10B. FIGS. 11A and 11B include discharge cover 122*a*, brace 122*b*, body chamber 120, socket 123, fastener 124, dirt tray pivot 128, pivot mount 132, vacuum head 136, bristles 138, wheels 140, spring loaded door 308, quick drain door 1001, screen 1002, dirt tray 1026, finger wells 1100, tabs 1106, axle 1108, tabs 1110, and rim 1112. In other embodiments, the assembly 1000 may not have all of the components listed above or may have other components instead of and/or in addition to those listed above.

Finger wells 1100 are indentations within dirt tray 1026 on both sides of screen 1002. Finger wells 1100 facilitate removing screen 1002 from dirt tray 1026 for cleaning purposes. Although FIG. 11 shows two finger wells, in other embodiments, there may be just one finger well or there may be more than two finger wells.

Tabs 1106 receives a rod for creating a hinge connecting dirt tray 1026 to body chamber 120. Axle 1108 forms the hinge that is received by tabs 1106. Tabs 1110 also have holes for receiving axle 1108. Tabs 1106 fit within tabs 1110, and the holes in tabs 1110 may be aligned with the holes in tabs 1106 and in tabs 1110. Once aligned, axle 1108 is inserted into the holes in tabs 1106 and in tabs 1110, and then secured by fastener 124 to create the hinge. Rim 1112 is a double rim on dirt tray 1026, upon which rigid mesh 206 and/or mesh 702 may rest.

Individual Components

The following drawings depict different views of the components that may be used in pool cleaner 100 to how the components may function and how the components may interact with other components.

FIGS. 12A-E show different views of an embodiment of an assembly of a handle that may be used in pool cleaner 100. FIGS. 12A-E include handle 102, handle socket 103, pole connector 104*a*, bracket screws 112, pole fasteners 1202, and fasteners 1206 and 1208. In other embodiments, the assembly may not have all of the components listed above or may have other components instead of and/or in addition to those listed above.

Handle 102, handle socket 103, pole connector 104*a*, and bracket screws 112 were described above in conjunction with FIG. 1.

Pole fasteners 1202 are for fastening an extending pole to the pole connector 104*a* to extend the reach of the pool cleaner 100. In one embodiment, a pole may include spring loaded push buttons to mate with a hole on the pole connector 104*a*. In another type of embodiment, another type of fastener may be used, such as screws or rivets. In another embodiment, pole connector 104*a* uses another locking mechanism to keep the pole from slipping off and/or rotating with respect to pool cleaner 100.

Optionally, handle 102 may have a grip to aid in holding pool cleaner 100 by handle 102.

Fasteners 1206 and 1208 attach handle 102 to power pack 106. In an embodiment, fasteners 1206 and 1208 are screw holes for engaging screws that hold power pack 106 to handle 102.

FIGS. 13A-E show different views of an embodiment of an assembly 1300 of the power pack attached to the handle that may be used in pool cleaner 100. FIGS. 13A-E include handle 102, handle socket 103, pole connector 104*a*, power pack 106, electrical caps 108*b*, on/off switch 110, bracket screws 112, locking pin 201, electrical socket 402, V-shaped portion 1302, and buttons 1304, and power pack screws 1306. In other embodiments, the assembly 1300 may not have all of the components listed above or may have other components instead of and/or in addition to those listed above.

Handle 102, handle socket 103, pole connector 104*a*, power pack 106, electrical caps 108*a* and 108*b*, on/off switch 110, bracket screws 112, and locking pin 201 were described above in conjunction with FIGS. 1 and 2. Electrical socket 402 was discussed in conjunction with FIG. 4.

V-shaped portion 1302 pushes outwards the buttons attached at the ends of the V to hold locking pin 201 in place. Locking pin 201 includes V-shaped portion 1302. Buttons 1304 are located at the end of the V-shaped portion 1302. Power pack screws 1306 are screws that hold power pack 106 to handle 102. In such assembly, power pack 106 may have four power pack screws 1306 on each corner of power pack 106 that mate with fasteners 1206 to ensure that power pack 106 is securely fixed to handle 102.

FIGS. 14A-E show different views of an embodiment of link 116 that may be used in pool cleaner 100. Link 116 may include link ends 1041, fasteners 1402 and link collar 1404. In other embodiments, the assembly may not have all of the components listed above or may have other components instead of and/or in addition to those listed above.

Link 116 was discussed above in conjunction with FIG. 1.

Optionally, both link ends 1401 of link 116 are slightly bent inward to guide the user to easily slide the link 116 into body connector 118 or handle connecter 114.

Fasteners 1402 are fasteners for connecting link 116 to handle connector 114 and body connector 118, which fasten to fasteners 1402. In an embodiment, fasteners 1402 are spring loaded push buttons that mate with holes in the part to which link 114 is being joined. For example, fasteners 114 may be made from lock pins 201. In one embodiment, link 116 may engage with the connectors via other fasteners such as screws. Alternatively, link 116 may have multiple fasteners 1402 aligning one or more sides of link 116 at a distance apart from one another, so that the user could adjust the length by choosing the slots on the connectors within which to fit the push buttons. In at least one embodiment, the fasteners 1402 might have cross sections that are not circular.

Link collar 1404 is a raised portion located in the middle of the link 116 to help the user align the fasteners 1402 to engage with the body connector 118 or handle connecter 114. Link collar 1404 acts as a stop, which prevents handle connector 114 and body connector 118 from sliding past the point where fasteners 1402 align with the corresponding structures on handle connector 114 and body connector 118. Link collar 1404 is optional.

FIGS. 15A-D show different views of an embodiment of an assembly 1500 of connectors that may be used in pool cleaner 100. FIGS. 15A-D include handle connector 114, link 116, body connector 118, fasteners 1402, bracket screw holes 1502 and hole 1504. In other embodiments, the assembly 1500 may not have all of the components listed above or may have other components instead of and/or in addition to those listed above.

Handle connector 114, link 116, and body connector 118 were discussed above in conjunction with FIG. 1. Fasteners 1402 were discussed in conjunction with FIG. 14.

Bracket screw holes 1502 are screw slots for the bracket screw fasteners 124 that fasten handle connector 114 to the handle 102. Hole 1504 is the screw hole for the fastener 124 that affixes body chamber 120 to body connector 118 to prevent body connector 118 from slipping off. In other embodiments, other fasteners may be substituted for the screws and screw holes.

FIGS. 16A-E show different views of an embodiment of discharge cover 122*a* that may be used in pool cleaner 100. Discharge cover 122*a* may include brace 122*b*, cover rim 1601, tabs 1602, extended portion 1604, grated openings 1606, fasteners 1608, guide poles 1610, and flange 1612. In other embodiments, discharge cover 122*a* may not have all of the components listed above or may have other components instead of and/or in addition to those listed above.

Discharge cover 122*a* and brace 122*b* were discussed above in conjunction with FIG. 1.

Cover rim 1601 is the rim of the discharge cover 122*a*, which may contain multiple tabs or other fasteners that engage notches in body chamber 120 for attaching discharge cover 122*a* to body chamber 120. Cover rim 1601 may also include an extended portion to connect the discharge cover 122*a* to the body connector 118.

Tabs 1602 are multiple tabs located on the rim of discharge cover 122*a* that engage notches in body chamber 120 for fastening the discharge cover 122*a* to the discharge end of the body chamber 120.

Extended portion 1604 is an extended structure connected to the cover rim 1601 of discharge cover 122*a*. Extended portion 1604 may include brace 122*b*, which includes a hole for the body connector 118 to enter, thus connecting the discharge cover 122*a* to the body connector 118. The extended portion 1604 may allow discharge cover 122*a* to slide up and down the body connector 118.

Grated openings 1606 are multiple openings, such as holes or slits, which are part of a grating within the cover rim 1601 to allow the water to flow out of body chamber 120 and back into the pool. Grated openings 1606 may prevent large pieces of dirt from entering body chamber 120 and protects the pump from colliding with any large objects that may fall on pool cleaner 100 while the cleaner is not in use. In one embodiment, grated openings 1606 could be in any shape, size or number, so as to allow the water to pass without significantly impeding the water flow.

Fasteners 1608 fasten the discharge cover 122*a* to the body chamber 120. In an embodiment, fasteners 1608 may be screw holes that mate with screws that screw body chamber 120 to discharge cover 122*a*. Discharge cover 122*a* may include guide poles 1610 that fits into the guide holes of the body chamber 120 for guiding the discharge cover 122*a* to align with the body chamber 120. In other embodiments, other types or numbers of fasteners may be included for attaching the discharge cover 122*a* to the body chamber 120 during assembly.

Flange 1612 may have a contour similar to a corresponding structure on the top of body chamber 120. Flange 1612 may help align discharge cover 122*a* with body chamber 120.

FIGS. 17A-E show different views of an embodiment of body chamber 120 that may be used in pool cleaner 100. Body chamber 120 includes socket 123, fastener 124, hole 404, fasteners 1701, discharge hole 1702, fasteners 1704, guide panels 1706, guide holes 1708, socket 1710, fastener 1712 and guide pole 1714. In other embodiments, body chamber 120 may not have all of the components listed above or may have other components instead of and/or in addition to those listed above.

Body chamber 120, socket 123, and fastener 124 were discussed above in conjunction with FIG. 1. Hole 404 was discussed above in conjunction with FIG. 4.

Fastener 1701 fastens to fastener 1608. Fastener 1701 may be a screw hole and a screw going through fastener 1701 and fastener 1608 (FIGS. 16A-16E) may hold discharge cover 122*a* to body chamber 120.

Discharge hole 1702 is a water outlet on the top of the body chamber 120, via which water is pushed out by pump 202. The propeller 302 may be placed close to or in the middle of discharge hole 1702, causing the water to flow out of the body chamber 120.

Fasteners 1704 may be three screws (or other fasteners) that fasten the three legs of the pump 202 to the body chamber 120. In another embodiment, the pump 202 may be connected to the body chamber 120, via different numbers of screws or other types of fasteners.

Guide panels 1706 are two parallel panels located on the intake opening of the body chamber 120, opposite to dirt tray pivot 128, for aligning and attaching the latch 130 to the body chamber 120. The latch 130 will be discussed further in conjunction with FIGS. 23A-E.

Guide holes 1708 of the body chamber 120 fit with the guide poles 1610 of the discharge cover 122*a* for guiding the discharge cover 122*a* to align well with the body chamber 120 during assembly.

Socket 1710 is a slot located in a raised portion on the discharge end of the body chamber 120 located opposite flange 1612 (FIGS. 16A-16E) to help align the discharge cover 122*a* with body chamber 120 while assembling pool cleaner 100. Socket 1710 may be replaced with a flange or posts opposite flange 1612 for aligning flange 1612. Flange 1612 and optionally socket 1710 may be replaced with a mating socket and tab for securing body chamber 120 and discharge cover 122*a* to one another. Alternatively, pump cage 204 may include a tab (not shown) opposite socket 1710 (e.g., on the rim of pump cage 204) that mates with socket 1710 for fastening the pump cage 204 to the body chamber 120 more securely. Socket 1710 is optional. Pump cage 204 does not need to attach to body chamber 120 as long as pump cage 204 is attached to pump 202. Alternatively, other types of fasteners could be used to fasten pump cage 204 to the body chamber 120.

Fastener 1712 is a screw located on the intake end of the body chamber 120 in-between the guide panels 1706, for fastening the hook portion of the latch 130 to the body chamber 120. Alternatively, multiple screws or other types of fasteners could be used to attach latch 130 to the body chamber 120.

Guide pole 1714 is a component located on the inner surface of the discharge end of the body chamber 120, opposite to the socket 1710, for the purpose of guiding pump cage 204 to align well with the socket 1710. Guide pole 1714 also aids in aligning propeller 302 with the middle of the discharge hole 1702.

FIGS. 18A-E show different views of an embodiment of pump 202 that may be used in pool cleaner 100. Pump 202 includes propeller 302, motor housing 1802, pump legs 1804, fastener 1806, and power cord inlet port 1808. In other embodiments, pump 202 may not have all of the components listed above or may have other components instead of and/or in addition to those listed above.

In an embodiment, pump 202 may not use propeller 302 to move the water within body chamber 120. Pump 202 is discussed above in conjunction with FIG. 2, and propeller 302 is discussed above in conjunction with FIG. 3.

Motor housing 1802 is part of the pump 202 that houses motor 304 for rotating the propeller 302. Motor housing 1802 includes screws at the bottom of the motor housing that fasten the pump cage 204 to the bottom of the pump 202.

Pump legs 1804 are three poles that attach the pump 202 to the body chamber 120, via fasteners 1704, thus placing propeller 302 close to the discharge end of the body chamber 120. In one embodiment, other structures may be used to connect the pump 202 to the body chamber 120 with other types of fasteners. Fastener 1806 may be screws that fasten the bottom part of the pump 202 to the pump cage 204 to hold the pump cage 204 in place, so that the pump cage 204 surrounding the pump 202 prevents the filter bag 306 from touching the pump 202, thereby protecting the filter bag 306 form being damaged by pump 202.

Power cord inlet port 1808 is the opening for connecting power cord 410 to the motor 304 for transmiting the electricity from battery blocks 300 within power pack 106 to motor 304 for powering pump 202 and turning propeller 302. Alternatively, power cord 410 connected to battery blocks 300 at one end could run through the hollow portion of handle connector 114, link 116 and body connector 118, into the body chamber 120, over the edge of the pump cage 204 and connected to motor 304 through power cord inlet port 1808. In an embodiment, power cord 410 may connect to pump 202 through an opening on the side of body chamber 120. In an embodiment, the electrical connections between power cord 410 and battery blocks 300 and between power cord 410 and pump 202 are hermetically sealed.

FIGS. 19A-E show different views of an embodiment of pump cage 204 that may be used in pool cleaner 100. Pump cage 204 may include upper portion 714, shelf 716, lower portion 718, fasteners 1902, cage wall openings 1904, cage bottom openings 1906 and flat portion 1908. In other embodiments, pump cage 204 may not have all of the components listed above or may have other components instead of and/or in addition to those listed above.

Pump cage 204 was discussed above in conjunction with FIG. 2.

Fasteners 1902 may be screws (or other fasteners) that hold the bottom of pump 202 to the bottom of lower portion 718 of the pump cage 204. In one embodiment, multiple fasteners 1902 could be used to fasten the pump 202 to the pump cage 204.

Cage wall openings 1904 are multiple openings, such as holes or slits, which are part of the gratings that makes up the pump cage 204 to allow the water to flow into the pump cage 204 while preventing the filter bag 306 from touching pump 202. In one embodiment, cage wall openings 1904 could be in any shape, size or number, so as to allow the water to pass without significantly impeding the water flow and preventing the filter bag 306 to get inside the pump cage 204. In one embodiment, cage wall openings 1904 are located on both upper portion 714 and lower portion 718.

Cage bottom openings 1906 are multiple openings, such as holes or slits, that form part of the grating on the bottom of lower portion 718 of the pump of the pump cage 204 to allow the water to flow into the pump cage 204 while preventing the filter bag 306 to touch the pump 202. In one embodiment, cage bottom openings 1906 could be in any shape, size or number, so as to allow the water to pass without significantly impeding the water flow and preventing the filter bag 306 from getting inside of pump cage 204.

Flat portion 1908 is a flat portion on the rim of the pump cage 204 for aligning the pump cage with the body chamber 120 so that the three legs of the pump 202 could align well and get connected to the body chamber 120 via fasteners 1704. In one embodiment, flat portion 1908 is facing the body connector 118 and could align with the guide pole 1714 located on the inner surface of the discharge end of the body chamber 120. In another embodiment, a tab is located on the rim of the pump cage 204, opposite to the flat portion 1908, which could mate with the socket 1710 for aligning and fastening the pump cage 204 to the body chamber 120.

FIGS. 20A-E show different views of an embodiment of an assembly 2000 that may be used in pool cleaner 100. FIGS. 20A-E may include pump 202, pump cage 204, propeller 302, upper portion 714, shelf 716, lower portion 718, and flat portion 1908. In other embodiments, the assembly 2000 may not have all of the components listed above or may have other components instead of and/or in addition to those listed above.

FIGS. 20A-E illustrate how pump 202 and pump cage 204 connect to one another. As discussed earlier (see FIG. 18), the pump legs engage corresponding structures on pump cage 204. Pump 202, pump cage 204, and propeller 302 were discussed, above, in conjunction with FIGS. 2 and 3. FIGS. 20A-E depict the different views of the assembly and how pump 202 may fit within pump cage 204.

FIGS. 21A-E show different views of an embodiment of rigid mesh 206 that may be used in pool cleaner 100. Rigid mesh 206 may include mesh rim 2102 and collar 2106. In other embodiments, the assembly 2000 may not have all of the components listed above or may have other components instead of and/or in addition to those listed above.

Rigid mesh 206 was discussed above in conjunction with FIG. 2.

Mesh rim 2102 is the base for the rigid mesh 206. Rigid mesh 206 may be attached to the body chamber 120, via any type of fasteners such as screws. Optionally, mesh filter 702 may attach to (and/or fit in) rigid mesh 206. In an embodiment tabs on mesh filter 702 engage notches in the mesh rim 2102 (not shown).

Collar 2106 is a flange located close to the mesh rim 2102 with a slightly smaller diameter than mesh rim 2102. In other embodiments, collar 2106 is optional, or may have other shapes or sizes. Filter bag 306 may fit inside rigid mesh 206, lining the interior of rigid mesh 206, with the ends of filter bag 306 wrapping around the outside of rigid mesh 206. Collar 2106 may be used for preventing the elastic or rubber band of filter bag 306 from slipping off the rigid mesh 206, so as to hold the filter bag 306 in place. In another embodiment, filter bag 306 may be held to rigid mesh 206 by another means.

FIGS. 22A-E show different views of an embodiment of dirt tray 126 that may be used in pool cleaner 100. Dirt tray 126 may include dirt tray pivot 128, pivot screw 134, dirt tray intake end 2202, locking latch guide panels 2204, and locking latch receiving portion 2206. In other embodiments, the dirt tray 126 may not have all of the components listed above or may have other components instead of and/or in addition to those listed above Dirt tray 126, dirt tray pivot 128, pivot screw 134 were discussed above in conjunction with FIG. 1.

Dirt tray intake end 2202 is an opening for receiving the discharge end of pivot mount 132. Dirt tray intake end 2202 is shaped so that the discharge end of pivot mount 132 fits in, and connects, to the dirt tray 126, while the cylindrical end of pivot mount 132 connects to the vacuum head 136, so as to allow water to flow through the pivot mount 132 into the dirt tray 126.

Locking latch receiving panels 2204 are two parallel panels located on the discharge end of dirt tray 126 for aligning the latch 130 to lock to the dirt tray 126. Locking latch receiving portion 2206 is a panel located in-between locking latch receiving panels 2204 on the discharge end of dirt tray 126. A hook portion of the latch 130 fits over the locking latch receiving portion 2206 so as to hold and lock the body chamber 120 and dirt tray 126 together. The latch 130 will be discussed further below in conjunction with FIGS. 23A-E. In other embodiments, other types or numbers of fasteners may be used to hold the body chamber 120 and dirt tray 126 together.

FIGS. 23A-E show different views of an embodiment of latch 130 that may be used in pool cleaner 100. FIGS. 23A-E include latch 130, which includes spring 208, and hook 2302. In other embodiments, latch 130 may not have all of the components listed above or may have other components instead of and/or in addition to those listed above.

Latch 130 and spring 208 were discussed above in conjunction with FIGS. 1 and 2, respectively.

Hook 2302 is a portion of a mechanical fastener that could lock the body chamber 120 and dirt tray 126 together when the two components are closed during use or storage. Hook 2302 could be unlocked from the receiving portion of latch 130 allowing the dirt tray 126 to open for cleaning purposes. In one embodiment, hook 2302 is the extended part of the hook portion, which could be attached to the guide panels 1706 on the intake side of body chamber 120 opposite to dirt tray pivot 128. Hook 2302 fits over the locking latch receiving portion 2206, which is located between locking latch receiving panels 2204 on the discharge end of dirt tray 126, so as to hold and lock the body chamber 120 and dirt tray 126 together. Guide panels 1706 help ensure that hook 2302 align with locking latch receiving portion 2206. Alternatively, latch 130 may include a clasp or a latch. In other embodiments, other types or numbers of fasteners may be used to hold the body chamber 120 and dirt tray 126 together.

FIGS. 24A-E show different views of an embodiment of pivot mount 132 that may be used in pool cleaner 100. Pivot mount 132 may include spring loaded door 308, hinge 902, pivot screws 210, pivot hole 212, locking grooves 2402 and collar 2404. In other embodiments, the assembly may not have all of the components listed above or may have other components instead of and/or in addition to those listed above. Pivot mount 132 was discussed above in conjunction with FIGS. 1 and 9.

Locking grooves 2402 are grooves in the collar of pivot mount 132 with openings on the intake side of the pivot mount 132. Locking grooves 2402 may engage with the locking posts located on the intake opening of the vacuum head 136 and lock and hold vacuum head 136 and pivot mount 132 together. In other embodiments, pivot mount 132 and vacuum head 136 could be held together using other fasteners or mechanisms.

Collar 2404 engages the base of pivot mount 132. Pivot mount 132 rotates within collar 2404 when connecting collar 2404 to the posts on vacuum head 136.

FIGS. 25A-E show different views of an embodiment of an assembly of vacuum head 136 that may be used in pool cleaner 100. FIGS. 25A-E include vacuum head 136, bristles 138, wheels 140, and locking posts 2502. In other embodiments, the assembly may not have all of the components listed above or may have other components instead of and/or in addition to those listed above.

Vacuum head 136, bristles 138, and wheels 140 were discussed above in conjunction with FIG. 1.

Locking posts 2502 located on the intake opening of the vacuum head 136 and may fit into the locking grooves 2402 of pivot mount 132 for locking and holding vacuum head 136 and pivot mount 132 together.

In an embodiment, the intake opening of vacuum head 136 is positioned in the center of the base plate. Bristles 138 are positioned in rows on the base plate, extending radially away from the intake opening. In another embodiment, the wheels are positioned in a triangular formation on the base plate around the intake opening.

Method of Operation

Figure 26:
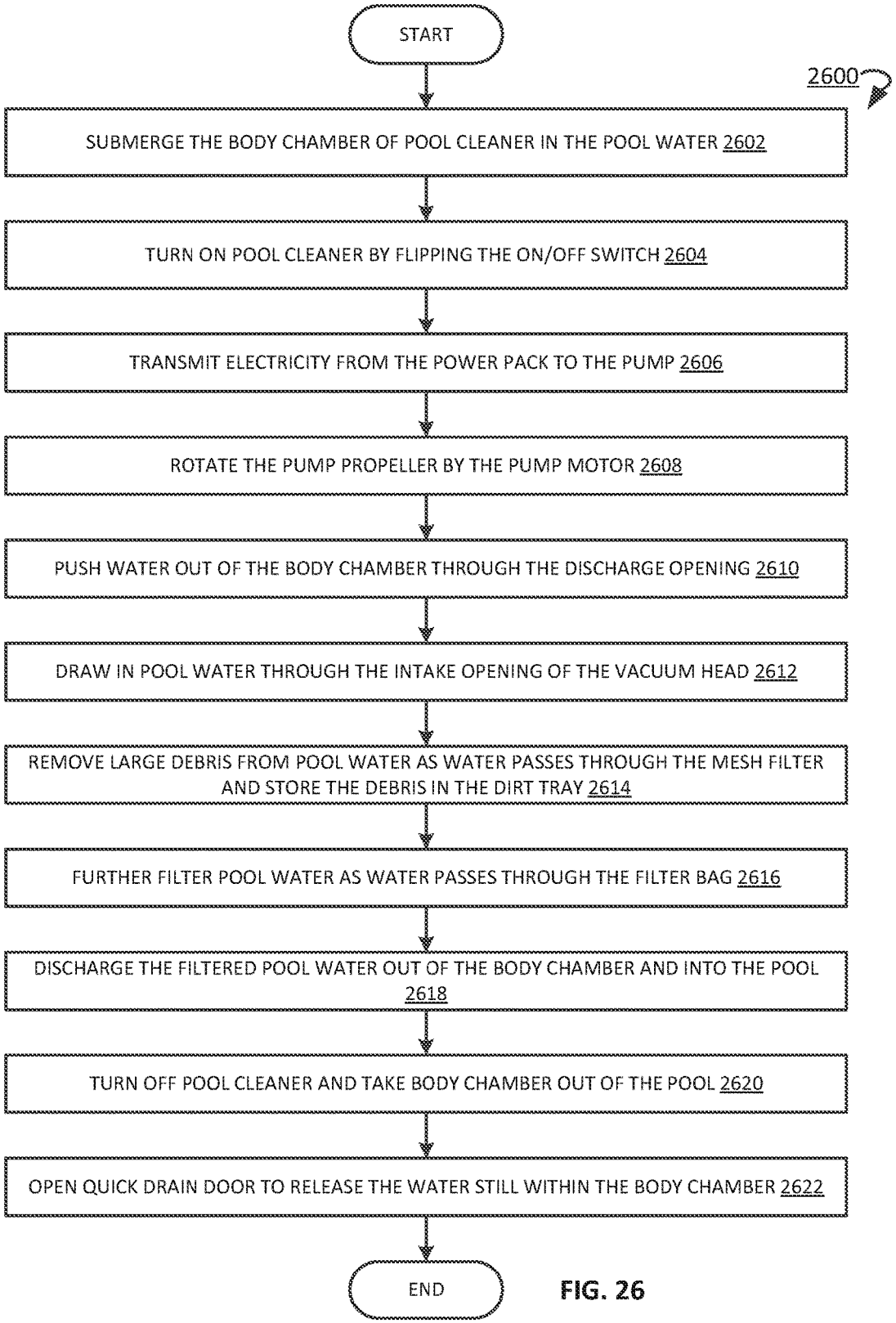
FIG. 26 shows a flowchart of an embodiment of a method for operating the pool cleaner of FIG. 1.

FIG. 26 shows a flowchart of an embodiment of a method 2600 for operating the pool cleaner of FIGS. 1-25.

In step 2602, the pool cleaner 100 is submerged in the pool water, thereby submerging body chamber 120. Pool cleaner 100 is weighted, so as to submerge when placed in water.

In step 2604, the pool cleaner is turned on by flipping the on/off switch 110.

In step 2606, electricity is transmitted from power pack 106 to pump 202 through power cord 410.

In step 2608, powered by the electricity, motor 304 within pump 202 rotates propeller 302.

In step 2610, as a result of the propeller rotating (in step 2608), water within body chamber 120 is pushed out through the discharge opening.

In step 2612, also as a result of the propeller rotating (in step 2608), water is drawn into body chamber 120 through the intake opening of vacuum head 136.

In step 2614, large debris in the water is removed as the water passes through mesh filter 702 and traps the large debris within dirt tray 126.

In step 2616, water leaving mesh filter 702 passes through filter bag 306, and filter bag 306 further filters the water as the water passes through filter bag 306.

In step 2618, pump 202 discharges the filtered water (that passed through mesh filter 702 and filter bag 306) out of body chamber 120 and back into the pool.

In step 2620, pool cleaner 100 is turned off by pressing on/off switch 110 and is taken out of the pool.

In step 2622, optionally, in embodiments having quick drain door 1001, quick drain door 1001 is opened to release the water buildup within body chamber 120.

In an embodiment, each of the steps of method 2600 is a distinct step. In another embodiment, although depicted as distinct steps in FIG. 26, step 2602-2622 may not be distinct steps. In other embodiments, method 2600 may not have all of the above steps and/or may have other steps in addition to or instead of those listed above. The steps of method 2600 may be performed in another order. Subsets of the steps listed above as part of method 2600 may be used to form their own method.

Method of Making

Figure 27:
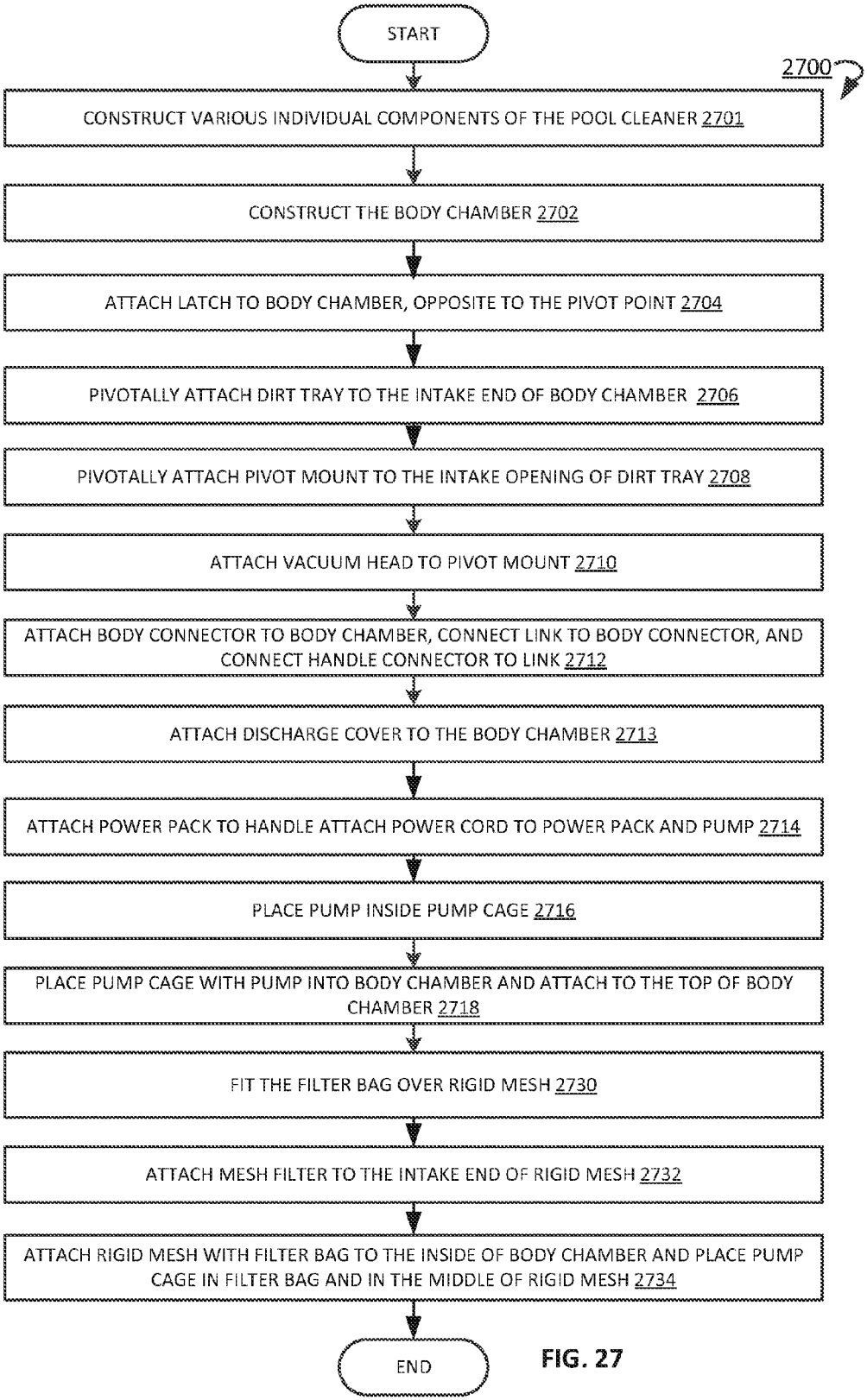
FIG. 27 is a flowchart of an embodiment of a method of making the pool cleaner of FIGS. 1-25.

FIG. 27 is a flowchart of an embodiment of method 2700 of making the pool cleaner of FIGS. 1-25.

In step 2701, the various individual components of pool cleaner 100 are constructed. Specifically, in step 2701, rigid mesh 206 (see FIGS. 2, 3, 6-8, and 21A-E) is formed and filter bag 306 (see FIGS. 3 and 7A-C) is also formed. Forming rigid mesh 206 may include forming a rim (and/or other fastener mechanisms) for securing rigid mesh 206 rest on dirt tray 126 and/or for attaching filter bag 306. The rim may be formed with holes or notches for attaching a coarse filter to. Forming filter bag 306 may optionally include attaching an elastic to the opening of filter bag 306 so that filter bag securely holds on to rigid mesh 206.

In step 2701, filter bag 306 is formed to be fitted over rigid mesh 206 to line the exterior and interior of rigid mesh 206, with the ends of filter bag 306 wrapped around the exterior of rigid mesh 206. The elastic in the end of filter bag 306 and collar 2106 of rigid mesh 206 holds filter bag 306 to rigid mesh 206. Filter bag 306 may be a bag made of fabric or similar porous material.

In step 2701, pump cage 204 is formed, which may include forming a rigid mesh basket with large holes so as not to impede water flow. Pump cage 204 may be formed of a size and shape so that pump 202 fits inside while leaving so that there is space between the rigid mesh and pump 202. Pump cage 204 may be formed with screw holes (and/or other fastening means) for attaching pump 202 to the bottom of pump cage 204. Pump cage 204 may be formed with a rim for securing pump cage 204 within body chamber 120. Pump cage 204 may be formed with an upper and lower half, where the upper half has a larger diameter than the lower half and part of the floor of pump cage 204 may be formed so as to be slanted.

In step 2701 pump 202 (see FIGS. 2-8, 18 A-E, and 20A-E) is placed inside pump cage 204. Pump 202 may be formed with an electrical motor, a housing, and a propeller. The electrical motor may be attached to an axle to which the propeller is also attached, so that when the electrical motor is on, the electrical motor turns the axle, and the turning of the axle turns the propeller.

In step 2701, discharge cover 122*a* (see FIGS. 1-6, 8, 11A, and 16A-E) is formed. Forming discharge cover 122*a* may include forming a grating within a rim frame, where the grating has multiple holes, via which water may pass without significantly impeding the water flow. Forming discharge cover 122*a*, may include forming tabs (or other fasteners on the rim of the discharge cover 122*a* that engage notches in body chamber 120 for attaching discharge cover 122*a* to body chamber 120.

In step 2701, mesh filter 702 (see FIGS. 7A-C and 8) may be formed. Forming mesh filter 702 may include forming a frame, and attaching a mesh to the frame. Forming mesh filter 702 may include forming tabs or other fasteners on the frame of mesh filter 702 that engage holes in rigid mesh 206. Alternatively, mesh filter 702 may have a fastener (e.g., tabs) for engaging dirt tray 126.

In step 2701, dirt tray 126 (see FIGS. 1-6, 8, 10A-B, 11A-B, and 22A-E) may be formed. Forming dirt tray 126 may include forming dirt tray pivot 128, which may involve forming two tabs with holes aligned with one another and a rod that is inserted in the two holes. Forming dirt tray 126 may also include forming a raised portion the floor of the dirt tray 126 through which pivot mount 132 may be inserted. Walls of the raised area may be formed with two aligned holes for engaging two pivots protruding from ball pivot 132. Optionally, forming dirt tray 126 may include forming an opening in the floor of dirt tray 126 surrounded by tabs or other structures for engaging frame having a mesh that covers the opening. Forming dirt tray 126 may also include forming a finger well next to the opening to aid in removing the frame of the mesh covering the opening. Forming dirt tray 126 may also include forming two tabs with holes or pivots aligned with one another near the opening in the floor of dirt tray 126, via which a quick release door 1001 may be pivotally attached to dirt tray 126. Forming dirt tray 126 may also include forming a rim for forming a seal with the rim of the container body 120 when dirt tray 126 is closed, and forming two flanges within which a portion of a latch may fit. Forming dirt tray 126 may include forming a structure, such as a flange or pocket that the latch engages when holding dirt tray 126 up against the bottom rim of container body 120 when dirt tray 126 is in a closed position. Forming dirt tray 126 may also include forming a spring that attaches to both the bottom of dirt tray 126 and quick release door 1001 to hold quick release door shut. Alternatively or additionally, quick release door 1001 may include a releasable tab or latch that engages the bottom of dirt tray 126 to hold quick release door 1001 closed.

In step 2701, latch 130 (FIGS. 1-6, 8, 23A-E) is formed. Forming latch 130 may include forming a channel into which a spring may be inserted that help holds the latch shut.

In step 2701, pivot mount 132 (see FIGS. 1-6, 8, 9, 10A-B, 11A-B, and 24A-E) is formed. Forming pivot mount 132 may include forming a stationary collar having two notches for attaching to vacuum head 136. Forming a hollow ball head through which water passes, with a hole in the top of the ball head for water to exit, and an open bottom via which water may enter. The pivot mount 132 may be formed in a shape that engages the collar in a manner that allows the ball head to swivel while connecting the collar to the vacuum head. Forming the pivot mount 132 may include forming two pivots that engage two holes in the raised portion of the floor dirt tray 126, so as to form a hinge for rotatably connecting pivot mount 132 to dirt tray 126 (the axis about which the ball head swivels is perpendicular to the axis about which dirt tray 126 pivots at the hinge formed by the two pivots on pivot mount 132). Forming pivot mount 132 may include forming a cover for the top of pivot mount 132, and forming a hinge for pivotally connecting pivot mount 132 to the cover. The hinge may be formed by one of the cover of the top of pivot mount having two tabs with aligned holes and the other having two tabs with aligned pivots that engage the two holes or by both having two tabs with aligned holes and a rod that fits into all four holes simultaneously. Forming the hinge may also involve forming and then attaching a spring to mechanically bias the cover closed, thereby forming a one-way valve.

In step 2701, vacuum head 136 (FIGS. 1-6, 8, 10A-B, 11A-B, and 25A-E) may be formed. Forming vacuum head 136 may include forming two protrusions that engage the two notches of the collar of pivot mount 132. Forming vacuum head 136 may also involve forming a well for inserting bristles and forming bristles that are inserted into the well and attached to the well. Forming vacuum head 136 may also involve forming two or more wheel wells, where each wheel well may include aligned holes that engage the axles or pivots (e.g., cylindrical protrusions that act as axles) on the wheels or may include aligned pivots in the wheel wells that engage holes on the wheels. Forming the wheels may involve forming axles and forming holes in the wheels into which the axles are inserted. Forming the wheels may involves forming pivots (on which the wheels rotate) on the wheels that engage holes on the vacuum head 136 or holes in the wheels that engage pivots on the vacuum head.

In step 2701, body connector 118 (see FIGS. 1-6 and 15A-D) may be formed for attaching to or as part of body chamber 120 and link 116. In step 2701, link 116 (see FIGS. 1-6, 14A-E, and 15A-D) may be formed for connecting to body connector 118 and handle connector 114. In step 2701, handle connector 114 (see FIGS. 1-6 and 15A-D) may be formed for connecting to link 116 and attaching to, or as part of, handle 102. Forming handle connector 114, link 116, and body connector 118 may involve forming hollow rods or bars, which may have a rectangular cross section (or may have a circular, hexagonal, octagonal, or another shaped cross section). Each may be formed with holes for engaging spring loaded depressible buttons that engage holes. Handle connector 114, link 116 and body connector 118 may be formed so that handle connector 114 and body connector 118 may be slid onto link 116, depressible buttons on link 116, body connector 118, and/or handles connector 114 align with and releasably engage holes on body connector 118 and handle connector 114 and/or on link 116, respectively. Alternatively, another fastener may be used instead. Forming handle connector 114 and body connector 118 may involve forming screw holes, nuts, and screws for fixedly attached to handle 102 to handle connector 114 and body connector 118 to container body 120. Alternatively, another fastener may be used.

In step 2701, handle 102 (FIGS. 1-6, 12A-E, and 13A-E) is formed with pole connector 104*a* (FIGS. 1-6, 12A-E, and 13A-E). Pole connector 104*a* (FIGS. 1-6, 12A-E, and 13A-E) allows a pole to be connected, extending the reach of the pool cleaner. In step 2701, a hole for bracket screw 112 and bracket screw 112 is formed for fixing handle 102 to handle connector 114.

In step 2701, power pack 106 (see FIGS. 1-6, and 13A-E) is formed. Forming power pack 106 may include forming fasteners for attaching power pack 106 to handle 102. Forming power pack 106 may involve forming electrodes for engaging the poles of batteries and wires connecting the electrodes to a power cord to the motor and optionally to a power cord to an outlet. In step 2701, power cord 410 is formed, which could be attached to power pack 106. Forming power pack 106 may involve forming electrical cap 108*b* (FIGS. 1-6, 12A-E, and 13A-E) that covers the electrical port, preventing water from entering into the port and damaging power pack 106.

Optionally, as part of step 2701, a coarse mesh may be placed in an opening at the bottom of dirt tray 126.

In step 2702, body chamber 120 (see FIGS. 1-6, 8, 11A, and 17A-E) is constructed. Body chamber 120 may be hollow and cylindrically shaped. One end of the body chamber 120 may be the intake end and the other end of the body chamber 120 may be the discharge end. In step 2702, constructing body chamber 120 (see FIGS. 1-6, 8, 11A, and 17A-E) may include forming a hollow and cylindrically shaped container. One end of the body chamber 120 may be formed to be the intake end and the other end of the body chamber 120 may be formed as the discharge end.

In step 2704, latch 130 (FIGS. 1-6, 8, 23A-E) is attached to body chamber 120 on the side opposite from dirt tray pivot 128. Latch 130 may lock dirt tray 126 shut, and hold dirt tray 126 and body chamber 120 closed during operation. Latch 130 may have spring 208. Optionally, also as part of step 2704, quick drain door 1001 may be attached to the opening in dirt tray 126 (if such an opening is present). Opening quick drain door 1001 allows quick release of water buildup within dirt tray 126.

In step 2706, dirt tray 126 (see FIGS. 1-6, 8, 10A-B, 1 lA-B, and 22A-E) may be pivotally attached to the body chamber 120. Dirt tray 126 may be attached by dirt tray pivot 128 (see FIGS. 1, 2, 5, 6, and 11A), which allows dirt tray 126 to be connected to body chamber 120 by one end while swinging freely when opened. In an embodiment, dirt tray 126 may have a second opening. In an embodiment, dirt tray 126 is attached to body chamber 126 prior to attaching pump 202, pump cage 204, rigid mesh 206, filter bag 306, and mesh filter 702.

In step 2708 pivot mount 132 (see FIGS. 1-6, 8, 9, 10A-B, 11A-B, and 24A-E) is pivotally attached to dirt tray 126, thereby attaching pivot mount 132 to body chamber 120, as a result of dirt tray 126 being pivotally connected to body chamber 120. Pivot mount 132 may allow vacuum head 136 to stay flat when body chamber 120 is tilted. Step 2708 may include attaching spring loaded door 308 to pivot mount 132. Pivot mount 132 may have spring loaded door 308 holding spring loaded door 308 closed, thereby acting as a one-way valve allowing dirt to flow into dirt chamber 126, while preventing water and debris from flowing from dirt tray 136 back into the pool.

In step 2710 vacuum head 136 (FIGS. 1-6, 8, 10A-B, 11A-B, and 25A-E) may be attached to pivot mount 132. In step 2710, bristles 138 attached to the bottom of vacuum head 136. Vacuum head 136 may have bristles 138 for scrubbing the surface of the pool. In step 2710, the axles are attached to wheels 140, and then attached to the wheels wells of vacuum head 136 (wheels 140 may facilitate easy maneuvering of pool cleaner 100 on the surface of the pool). In an embodiment, after bristles 138 and wheels 140 are attached to vacuum head 136, vacuum head 136 is attached to pivot mount 132.

In step 2712, body connector 118 (see FIGS. 1-6 and 15A-D) is attached to body chamber 120. In step 2712, link 116 (see FIGS. 1-6, 14A-E, and 15A-D) may be connected to body connector 118. In step 2712, handle connector 114 (see FIGS. 1-6 and 15A-D) is connected to link 116.

Optionally there may be a step in which handle 102 (FIGS. 1-6, 12A-E, and 13A-E) is connected to pole connector 104*a* (FIGS. 1-6, 12A-E, and 13A-E) (if pole connector was not formed as part of handle 102) and attached to handle connector 114. Pole connector 104*a* (FIGS. 1-6, 12A-E, and 13A-E) allows a pole to be connected to pool cleaner 100, extending the reach of the pool cleaner. In step 2726, bracket screw 112 is attached to handle 102 to connect handle 102 to handle connector 114.

In step 2713, discharge cover 122*a* (see FIGS. 1-6, 8, 11A, and 16A-E) is attached at the discharge end of body chamber 120. Discharge cover 122*a* (which is optional) may have multiple openings for water to flow out of body chamber 120 and back into the pool and brace 122*b*.

In step 2714, power pack 106 (see FIGS. 1-6, and 13A-E) is attached to handle 102. In step 2714, power cord 410 is attached to power pack 106. Power pack 106 may be electrically connected to the pump 202 by a power cord 410. In step 2714, power cord 410 may run through handle connector 114, link 116, and body connector 118 to attach power cord 410 to pump 202. Power pack 106 may house battery blocks 300 (see FIGS. 3 and 4), which may be rechargeable batteries. Power pack 106 may have electrical caps 108*a* and 108*b* (see FIGS. 1-6, 12A-E, and 13A-E) that cover the electrical port, preventing water from entering into the port and damaging power pack 106. The electrical port may allow a plug to be connected to charge battery blocks 300, where the plug is plugged into an AC outlet or to an external battery.

In step 2716, pump 202 (see FIGS. 2-8, 18 A-E, and 20A-E) is placed inside pump cage 204. The pump 202 may have an intake end and a discharge end. In an embodiment, the discharge end may be the side with propeller 302 (see FIGS. 3, 7A-C, 18A-E and 20A-E) (in other embodiments, the discharge end is the side without the propeller—pump 202 is configured to have the propeller spin in a direction that is appropriate, according to whether the propeller is to be on the discharge end or the intake end and according to the angle of the propellers). Pump 202 may be oriented in a way where the intake end faces the inside of pump cage 204 and the discharge end faces outward toward the discharge end of body chamber 120.

In step 2718, pump cage 204 (see FIGS. 2, 3, 5-8, 19A-E, and 20A-E) with pump 202 is placed into body chamber 120 and attached to the top of container body 120 (on the discharge end of container body 120). The open end of pump cage 204 may face outward pointing in the direction that water discharges.

Steps 2730-2734 are a sub method of method 2700 for installing the filters in pool cleaner 100. Steps 2730-2734 may be repeated any time both filters are changed.

In step 2730, rigid mesh 206 (see FIGS. 2, 3, 6-8, and 21A-E) is fitted with filter bag 306 (see FIGS. 3 and 7A-C), which is placed over rigid mesh 206. Filter bag 306 may be held to rigid mesh 206 by elastic or a rubber band, which optionally may be part of filer bag 306, or by another means. Filter bag 306 may be placed within rigid mesh 206, lining the exterior and interior of rigid mesh 206, with the ends of filter bag 306 wrapped around the exterior of rigid mesh 206. Filter bag 306 may be a bag has two layers of fabric—one layer is made of fabric made from nylon and the other layer of fabric, the lining, is made from cotton. In other embodiments, the fabrics that make up filter bag 306 may be polyester, rayon, wool, and/or other materials. In other embodiments, there may be just one layer of fabric or more than two layers of fabric, as long as the bag is sufficiently porous and the pump produces sufficient pressure drop to draw the water through and suck dirt off the pool floor and walls.

In step 2732, mesh filter 702 (see FIGS. 7A-C and 8) is attached to rigid mesh 206, covering one end of rigid mesh 206. Mesh filter 702 may be a coarse filter to prevent large debris from flowing into body chamber 120 and trapping the large debris within dirt tray 126.

In step 2734, rigid mesh 206 with filter bag 306 and mesh filter 702 is placed inside placed on top of dirt tray 126, and dirt tray 126 is closed. Closing dirt tray 126 places pump cage in filter bag 306 and in the middle of rigid mesh 206 when rigid mesh 206 is attached to the bottom of body chamber 120. Filter bag 306 may cover part of the sides of pump cage 204. Additionally, there may be space between the interior walls of body chamber 120 and rigid mesh 206. In another embodiment, mesh filter 702 is placed on dirt tray 126 and rigid mesh 206 is placed on top of mesh filter 702 on dirt tray 126, without mesh filter 702 being rigidly attached to rigid mesh 206, via tabs. In an alternative embodiment, rigid mesh 126, with mesh filter 702 attached, is attached to the bottom of body chamber 120. In yet another alternative embodiment, mesh filter 702 is attached to dirt tray 126 and rigid mesh 126 is attached to body chamber 120.

In an embodiment, each of the steps of method 2700 is a distinct step. In another embodiment, although depicted as distinct steps in FIG. 27, step 2702-2728 may not be distinct steps. In other embodiments, method 2700 may not have all of the above steps and/or may have other steps in addition to or instead of those listed above. The steps of method 2700 may be performed in another order. In fact, although component needs to be formed prior to being attached, the attaching and mounting steps could be performed in nearly any order. Subsets of the steps listed above as part of method 2700 may be used to form their own method.

Other Extensions

Each embodiment disclosed herein may be used or otherwise combined with any of the other embodiments disclosed. Any element of any embodiment may be used in any embodiment.

Although the invention has been described with reference to specific embodiments, it will be understood by those skilled in the art that various changes may be made and equivalents may be substituted for elements thereof without departing from the true spirit and scope of the invention. In addition, modifications may be made without departing from the essential teachings of the invention.

The invention claimed is:

1. A pool cleaner, comprising:

a housing, including at least an intake end and a discharge end;

a pump for drawing fluid from the intake end and expelling the fluid through the discharge end;

a first filter for filtering out debris of a first size, the first filter filtering fluid coming through the intake end of the housing; and a second filter for filtering out debris of a second size, wherein the first filter is coarser than the second filter and debris of the first size is larger than the debris of the second size, the second filter being placed between the pump and the intake end of the housing, the second filter filtering fluid coming through the first filter, and a filter cage supporting the second filter.

2. The pool cleaner of claim 1, further comprising a power cord for providing power to the pump, the power cord being electrically connected to the pump; and an immersible power pack, the immersible power pack being attached to the power cord.

3. The pool cleaner of claim 2, wherein the power pack includes at least a switch that turns the pool cleaner on and off.

4. The pool cleaner of claim 2, wherein the power pack includes at least a charging port that can be plugged into an AC outlet or to an external battery.

5. The pool cleaner of claim 1, further comprising a discharge cover covering the discharge end of the housing, the discharge cover having multiple small openings on the surface to allow fluid to pass through and preventing large debris from colliding with the pump.

6. The pool cleaner of claim 1, further comprising a pump cage surrounding the pump on sides of the pump facing the second filter, wherein the pump cage is positioned between the second filter and the pump.

7. The pool cleaner of claim 1, wherein the second filter is positioned, so as to line the inside and outside of the filter cage.

8. The pool cleaner of claim 1, the pool cleaner being a hand push pool cleaner, the pool cleaner further comprising an arm attached to and extending away from the housing at one end of the arm and handle attached to another end of the arm, the handle and arm allow the pool cleaner to be pushed by the handle, while the pool cleaner is in the pool and clean the pool.

9. A pool cleaner, comprising:
a housing, including at least
an intake end and a discharge end;
a pump for drawing fluid from the intake end and expelling the fluid through the discharge end;
a mesh filter for filtering out large debris, the mesh filter filtering fluid coming through the intake end of the housing; and
a fine filter for filtering out fine particles, the fine filter being placed between the pump and the intake end of the housing, the fine filter filtering fluid coming through the mesh filter, wherein
a power pack includes at least a removable cap covering the charging port to prevent water from entering the power pack.

10. A pool cleaner, comprising:
a housing, including at least
an intake end and a discharge end;
a pump for drawing fluid from the intake end and expelling the fluid through the discharge end;
a mesh filter for filtering out large debris, the mesh filter filtering fluid coming through the intake end of the housing; and
a fine filter for filtering out fine particles, the fine filter being placed between the pump and the intake end of the housing, the fine filter filtering fluid coming through the mesh filter, further comprising
a power cord for providing power to the pump, the power cord being electrically connected to the pump; and
an immersible power pack, the immersible power pack being attached to the power cord, further comprising
a handle, the handle being detachably attached to the power pack.

11. The pool cleaner of claim 10, wherein
the handle includes at least a socket for engaging a pole that couples to the housing.

12. A pool cleaner, comprising:
a housing, including at least
an intake end and a discharge end;
a pump for drawing fluid from the intake end and expelling the fluid through the discharge end;
a mesh filter for filtering out large debris, the mesh filter filtering fluid coming through the intake end of the housing; and
a fine filter for filtering out fine particles, the fine filter being placed between the pump and the intake end of the housing, the fine filter filtering fluid coming through the mesh filter, the housing further including
a body chamber, the body chamber having an intake end and a discharge end, the discharge end of the body chamber being the discharge end of the housing, the discharge end of the body chamber having an opening, the intake end of the body chamber having an opening, the opening at the intake end of the body chamber being blocked by the mesh filter, the pump and the fine filter being located in the body chamber; and
a dirt tray for catching large debris, the dirt tray having an intake end and a discharge end, the discharge end of the dirt tray being the discharge end of the housing, the discharge end of the dirt tray having an opening, the discharge end of the dirt tray being connected to the intake end of the body chamber.

13. The pool cleaner of claim 12, further comprising
a vacuum head, the vacuum head having an intake opening for drawing in fluid; and
a channel leading from the intake opening of the vacuum head to the opening at the intake end of the dirt tray.

14. The pool cleaner of claim 13, further comprising
a connector having a first end pivotally connected to the opening at the intake end of the dirt tray, so as to pivot about one axis and a second end of the connector rigidly connected to the vacuum head.

15. The pool cleaner of claim 14, wherein
the connector including at least a spring-loaded door, forming a one-way valve covering the first end of the connector, which is connected to the opening at the intake end of the dirt tray, the one-way valve hampering debris in the dirt tray from flowing out of the dirt tray.

16. The pool cleaner of claim 13, wherein
the vacuum head includes at least a base plate having wheels attached to the base plate.

17. The pool cleaner of claim 16, wherein
the base plate of the vacuum head has bristles on the bottom end of the base plate that faces away from the housing.

18. The pool cleaner of claim 12, further comprising
a spring-loaded door, forming a one-way valve covering the opening at the intake end of the dirt tray, the one-way valve hampering debris in the dirt tray from flowing out of the dirt tray.

19. The pool cleaner of claim 12, wherein
the body chamber and the dirt tray are pivotally attached at one end, allowing the dirt tray to swing open without detaching from the body chamber; and
wherein the body chamber has a latch on the other end of the body chamber and the dirt tray, locking the body chamber and the dirt tray together when the dirt tray is closed.

20. The pool cleaner of claim 12, wherein
the intake end of the dirt tray has a second opening, the second opening being covered by a flap, which when opened drains fluid buildup within the dirt tray.

21. The pool cleaner of claim 20, wherein
the second opening of the dirt tray has a screen covering the second opening for preventing debris from flowing out of the dirt tray when the flap is opened.

22. The pool cleaner of claim 20, wherein
the dirt tray includes at least one finger well next to the second opening.

23. A pool cleaner, comprising:
a housing, including at least
an intake end and a discharge end;
a pump for drawing fluid from the intake end and expelling the fluid through the discharge end;
a mesh filter for filtering out large debris, the mesh filter filtering fluid coming through the intake end of the housing; and
a fine filter for filtering out fine particles, the fine filter being placed between the pump and the intake end of the housing, the fine filter filtering fluid coming through the mesh filter, wherein the fine filter is a filter bag.

24. A pool cleaner, comprising:
a housing, including at least
an intake end and a discharge end;
a pump for drawing fluid from the intake end and expelling the fluid through the discharge end;
a mesh filter for filtering out large debris, the mesh filter filtering fluid coming through the intake end of the housing;
a fine filter for filtering out fine particles, the fine filter being placed between the pump and the intake end of the housing, the fine filter filtering fluid coming through the mesh filter, wherein the fine filter is a filter bag; and a mesh structure, the filter bag being placed within the mesh structure so that the filter bag lines the interior of the mesh structure and the ends of the filter bag cover the exterior of the mesh structure.

25. The pool cleaner of claim 24, further comprising a cage surrounding the pump, the cage being fitted within the filter bag.

26. A pool cleaner for cleaning a pool, the pool cleaner comprising:

a housing, including at least an intake end and a discharge end;

a pump for drawing fluid from the intake end and expelling the fluid through the discharge end, the pump having an intake side and a discharge side;

a first filter for filtering water drawn into the housing from the intake end of the housing by the pump, the first filter filtering out particles of a first size; a second filter for filtering water that was already filtered by the first filter, the second filter filtering out particles of a second size, the particles of the second size being smaller than the particles of the first size;

a power cord for providing power to the pump, the power cord being electrically connected to the pump by an electrical cord;

an immersible power pack attached to the power cord; and a handle attached to the power pack.

27. A pool cleaner for cleaning a pool, the pool cleaner comprising:

a body chamber, including at least an intake end and a discharge end;

a pump for drawing fluid from the intake end and expelling the fluid through the discharge end, the pump having an intake side and a discharge side;

a filter for filtering particles out of the fluid entering the intake end of the body chamber, drawn in by the pump;

a dirt tray for catching debris removed from the water by the filter, the dirt tray having an intake end and a discharge end, the intake end having an opening and the discharge end having an opening, the discharge end of the dirt tray being connected to the intake end of the body chamber;

a vacuum head, having an intake opening for drawing in fluid, a channel leading from the intake opening of the vacuum head to the opening at the intake end of the dirt tray.

28. A pool cleaner for cleaning a pool, the pool cleaner comprising:

a housing, including at least an intake end and a discharge end;

a pump for drawing fluid from the intake end and expelling the fluid through the discharge end, the pump having an intake side and a discharge side;

a fine filter including a filter bag for filtering out fine particles; and a coarse filter for filtering out large debris being placed on a first side of the filter bag, and the pump being located on another side of the filter bag, the coarse filter being located at the intake end of the housing.

29. A method of using a pool cleaner, comprising:

turning on the pool cleaner by at least turning on a pump of the pool cleaner, the pool cleaner including at least a housing, the housing including at least an intake end and a discharge end;

the pump;

a coarse filter, the coarse filter being located at the intake end of the housing;

a fine filter, the fine filter being placed between the pump and the coarse filter;

a head having a base plate at the intake end; and a handle for pushing the pool cleaner;

drawing in fluid, by the pump, through the intake end of the housing, while manually operating the pool cleaner with the handle and while keeping the base plate at a fixed orientation with respect to a floor of the pool cleaner on which the pool cleaner is being operated;

filtering out large debris by the coarse filter;

filtering out fine particles by the fine filter; and expelling the fluid through the discharge end of the housing.

30. A method of making a pool cleaner, the method comprising:

forming a housing, the housing having an intake end and a discharge end;

forming a pump for drawing fluid from the intake end and expelling the fluid through the discharge end;

forming a first filter for filtering out a first sized particle, and placing the first filter between the pump and the intake end of the housing;

forming a second filter for a second sized particle for filtering water from the filter for the first sized particle, wherein the second filter is finer than the first filter and the first sized particle is larger than the second sized particle;

placing the first filter at the intake end of the housing such that the second filter is located between the pump and the first filter, wherein the filter for the second sized particle is closer to the pump than the filter for the first sized particle;

forming a head having a base plate at the intake end;

forming a handle for pushing the pool cleaner; and attaching the head to the housing, such that while being operated on a flat surface, the base plate will remain at a fixed orientation with respect to the flat surface.

31. A pool cleaner, comprising:

a housing, including at least an intake end and a discharge end;

a pump for drawing fluid from the intake end and expelling the fluid through the discharge end;

a coarse filter for filtering out large debris, the coarse filter filtering fluid coming through the intake end of the housing; and a fine filter for filtering out fine particles, the fine filter being placed between the pump and the intake end of the housing, the fine filter filtering fluid coming through the coarse filter;

a head having at least three wheels for supporting the pool cleaner, holding the head at a fixed orientation with respect to a surface, while being operated while on the surface; and a handle for pushing the pool cleaner.

32. The pool cleaner of claim 31, wherein the coarse filter is a mesh filter.

* * * * *